US007583015B2

(12) United States Patent
Nukanobu et al.

(10) Patent No.: US 7,583,015 B2
(45) Date of Patent: Sep. 1, 2009

(54) ELECTRON-EMITTING DEVICE, ELECTRON-EMITTING APPARATUS, ELECTRON SOURCE, IMAGE DISPLAY DEVICE AND INFORMATION DISPLAY/REPRODUCTION APPARATUS

(75) Inventors: Koki Nukanobu, Kanagawa-Ken (JP); Keisuke Yamamoto, Kanagawa-Ken (JP); Tamaki Kobayahsi, Kanagawa-Ken (JP); Takuto Moriguchi, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 776 days.

(21) Appl. No.: 11/131,195

(22) Filed: May 18, 2005

(65) Prior Publication Data

US 2005/0258734 A1 Nov. 24, 2005

(30) Foreign Application Priority Data

May 18, 2004 (JP) ..... 2004-147836
Apr. 7, 2005 (JP) ..... 2005-110981

(51) Int. Cl.
*H01J 1/88* (2006.01)
*H01J 1/30* (2006.01)

(52) U.S. Cl. ..... 313/309; 313/310; 313/495; 313/496; 313/497

(58) Field of Classification Search ..... 313/309, 313/310, 495–497
See application file for complete search history.

(56) References Cited

U.S. PATENT DOCUMENTS 5,386,172 A * 1/1995 Komatsu ..... 313/309
5,502,314 A * 3/1996 Hori ..... 257/10
5,847,495 A 12/1998 Yamanobe et al. ..... 313/310
6,147,449 A 11/2000 Iwasaki et al. ..... 313/495
6,171,162 B1 1/2001 Iwasaki et al. ..... 445/6
6,179,678 B1 1/2001 Kishi et al. ..... 445/24
6,184,610 B1 2/2001 Shibata et al. ..... 313/309
6,225,749 B1 5/2001 Kobayashi et al. ..... 315/169.3
6,246,168 B1 6/2001 Kishi et al. ..... 313/495
6,267,636 B1 7/2001 Onishi et al. ..... 445/6
6,334,801 B1 1/2002 Kawade et al. ..... 445/24
6,379,211 B2 4/2002 Onishi et al. ..... 445/73
6,380,665 B1 4/2002 Motoi et al. ..... 313/310
6,409,563 B1 6/2002 Tamura et al. ..... 445/3
6,617,773 B1 9/2003 Yamamoto et al. ..... 313/310
6,633,118 B1 10/2003 Yamamoto et al. ..... 313/495
6,642,649 B1 11/2003 Yamamoto et al. ..... 313/495
6,726,520 B2 4/2004 Takeda et al. ..... 445/62
6,731,060 B1 5/2004 Yamamoto et al. ..... 313/495

(Continued)

FOREIGN PATENT DOCUMENTS

JP 2000-231872 8/2000

(Continued)

*Primary Examiner*—Nimeshkumar D. Patel
*Assistant Examiner*—Anthony T Perry
(74) *Attorney, Agent, or Firm*—Fitzpatrick, Cella, Harper & Scinto

(57) ABSTRACT

By applying a drive voltage Vf [V] between first and second conductive films, when electrons are emitted by the first conductive film, an equipotential line of 0.5 Vf [V] is inclined toward the first conductive film, rather than toward the second conductive film, in the vicinity of the electron emitting portion of the first conductive film, in a cross section extending across the electron emitting portion and the portion of the second conductive film located nearest the electron emitting portion. The present invention improves electron emission efficiency.

1 Claim, 24 Drawing Sheets

U.S. PATENT DOCUMENTS

| | | | | |
|---|---|---|---|---|
| 6,802,753 | B1 | 10/2004 | Ando et al. | 445/6 |
| 6,831,401 | B1 | 12/2004 | Yamamoto et al. | 313/495 |
| 6,835,110 | B2 | 12/2004 | Mizuno et al. | 445/6 |
| 6,849,999 | B1 | 2/2005 | Kobayashi et al. | 313/495 |
| 6,876,156 | B1 | 4/2005 | Yamamoto et al. | 315/169.3 |
| 6,896,571 | B2 | 5/2005 | Mizuno et al. | 445/24 |
| 6,900,581 | B2 | 5/2005 | Kyogaku et al. | 313/310 |
| 2001/0054865 | A1 | 12/2001 | Danjo et al. | 313/495 |
| 2002/0060516 | A1* | 5/2002 | Kawate et al. | 313/495 |
| 2002/0096986 | A1 | 7/2002 | Motoi et al. | 313/310 |
| 2003/0161942 | A1 | 8/2003 | Arai et al. | 427/77 |
| 2005/0035703 | A1 | 2/2005 | Yamamoto et al. | 313/495 |
| 2005/0164591 | A1 | 7/2005 | Mizuno et al. | 445/24 |
| 2005/0194912 | A1 | 9/2005 | Kobayashi et al. | 315/169.1 |
| 2005/0225230 | A1 | 10/2005 | Takeda et al. | 313/496 |
| 2005/0236952 | A1 | 10/2005 | Moriguchi et al. | 313/310 |
| 2005/0236965 | A1 | 10/2005 | Yamamoto et al. | 313/496 |
| 2005/0258734 | A1 | 11/2005 | Nukanobu et al. | 313/495 |
| 2005/0282458 | A1 | 12/2005 | Takeda et al. | 445/46 |

FOREIGN PATENT DOCUMENTS

| | | |
|---|---|---|
| JP | 2000-251642 | 9/2000 |
| JP | 2000-251643 | 9/2000 |

* cited by examiner

ELECTRON-EMITTING DEVICE, ELECTRON-EMITTING APPARATUS, ELECTRON SOURCE, IMAGE DISPLAY DEVICE AND INFORMATION DISPLAY/REPRODUCTION APPARATUS

BACKGROUND OF THE INVENTION

1. Field of the Invention

The present invention relates to an electron-emitting device, an electron-emitting apparatus, an electron source using the electron-emitting device and an image display device using the electron source. The present invention also relates to an information display/reproduction apparatus that receives a broadcast signal for a television broadcast and displays and reproduces video information, character information and audio information included in the broadcast signal.

2. Description of the Related Art

One type of electron-emitting apparatus employs an electron-emitting device of either a field emission type or a surface conduction type. As is further disclosed in patent documents 1 to 3 identified below, a process called an "activation" process is sometimes performed for the surface conduction electron-emitting device. The "activation" process is one for forming a carbon film in a gap between a pair of conductive films and on a conductive film near the gap. FIG. 21 is a schematic cross-sectional view of an electron-emitting device disclosed in patent document 3. In FIG. 21, the electron-emitting device arranged on a surface of a substrate 1 comprises conductive films (4*a* and 4*b*) facing each other across a first gap (7), and carbon films (21*a* and 21*b*) facing each other across a second gap (8). A recessed portion 22 may be arranged at a part of the surface of the substrate 1 located between the second gap (8) or the first gap (7).

An image display apparatus can be obtained by maintaining a vacuum space between a first substrate having an electron source and a second substrate having a light-emitting film. The electron source may be composed of a plurality of the electron-emitting devices arranged in rows and columns on the first substrate. The light-emitting film also may be composed of a phosphor and an anode electrode such as an electroconductive film.

[Patent Document 1]

Japanese Patent Laid-Open Publication No. 2000-251642

[Patent Document 2]

Japanese Patent Laid-Open Publication No. 2000-251643

[Patent Document 3]

Japanese Patent Laid-Open Publication No. 2000-231872

SUMMARY OF THE INVENTION

For recent image display devices, there is a need for images to be displayed more brightly and more stably for a long period of time. Thus, there is a demand for an electron-emitting device that provides a higher and more stable electron emission efficiency. The electron emission efficiency is the ratio of a current (hereinafter referred to as an emission current Ie) that is emitted to a vacuum to a current (hereinafter referred to as a device current If) that flows across a pair of conductive films when a voltage is applied thereto. That is, for the electron-emitting device, it is preferable that the device current If be as small as possible and that the emission current Ie be as large as possible. When a high electron emission efficiency can be stably maintained for an extended period of time, an image display device (e.g., a flat television) can be obtained that provides, at a low power consumption, bright, high quality images.

The present invention therefore provides an electron-emitting device that enables an electron source to have a high electron emission efficiency and a satisfactory electron emission characteristic for an extended time period, an electron source that uses the electron-emitting device, and an image display device.

To resolve the conventional problems, this invention provides an electron-emitting device comprising: a first conductive film having an end portion, and a second conductive film having an end portion being separated from the end portion of the first conductive film and facing the end portion of the first conductive film. The end portion of the second conductive film includes a first portion, a second portion and a third portion, and the first portion is located between the second and third portions. A thickness of the second conductive film at the first portion is smaller than the thickness of the second conductive film at the second and third portions. A thickness of the end portion of the first conductive film facing the first portion is smaller than the thickness of the second conductive film at the second and third portions.

For the electron-emitting device of the invention, the thickness of the end portion of the first conductive film facing the first portion is approximately equal to or greater than the thickness of the first portion of the second conductive film.

For the electron-emitting device of the invention, the first conductive film further has a fourth portion and a fifth portion. The end portion facing the first portion is arranged between the fourth and fifth portions, and a distance between the end portion facing the first portion and the second conductive film is smaller than distances between the fourth and fifth portions and the second conductive film.

For the electron-emitting device of the invention, when a distance between the first portion and the end portion of the first conductive film facing the first portion is defined as d, differences between the thickness of the second conductive film at the first portion and the thickness of the second conductive film at the second and the third portions are set equal to or greater than 2d and equal to or less than 200d.

For the electron-emitting device of the invention, when a distance between the first portion and the end portion of the first conductive film facing the first portion is defined as d, a distance between the second portion and the third portion is set equal to or greater than 2d and equal to or smaller than 50d.

For the electron-emitting device of the invention, when a distance (the shortest distance) between the first portion and the end portion facing the first portion is defined as d, thicknesses of the second conductive film at the second and third portions, in a direction in which the first portion and the end portion of the first conductive film oppose each other, are equal to or less than 200d.

For the electron-emitting device of the invention, a distance between the first portion of the end portion of the first conductive film facing the first portion is equal to or greater than 1 nm and equal to or less than 10 nm. For the electron-emitting device of the invention, the first conductive film and the second conductive film preferably are carbon films.

For the electron-emitting device of the invention, the first and second conductive films are arranged on a surface of a substrate having a recessed portion located between the first and second conductive films.

Furthermore, the present invention provides, according to another aspect, an electron-emitting device having a first conductive film including an electron emission portion and a second conductive film including a portion facing the electron emission portion, arranged at an interval.

A thickness of the second conductive film at the portion facing the electron emission portion is equal to or not larger than a thickness of the first conductive film at the electron emission portion.

When electrons are emitted by applying a drive voltage Vf [V] between the first conductive film and the second conductive film so that a potential of the second conductive film is higher than a potential of the first conductive film, an equipotential line of 0.5 Vf [V], in a vicinity of the electron emission portion in a cross section extending across the electron emission portion and the portion facing the electron emission portion, is inclined toward the first conductive film.

The present invention also provides an electron source including a plurality of electron-emitting devices according to the invention, and provides an image display device comprising the electron source and a light-emitting member.

The present invention also provides an information display/reproduction apparatus that comprises at least a receiver, for outputting at least video information, character information or audio information included in a received broadcast signal, and the above described image display device, which is connected to the receiver.

According to another aspect of the present invention, an electron-emitting apparatus is provided, comprising an electron-emitting device including a first conductive film and a second conductive film arranged at an interval, on a surface of a substrate, and also comprising an anode electrode located at a distance H [m] from the surface of the substrate.

A voltage Va [V] is applied between the anode electrode and the first conductive film so that a potential of the anode electrode is higher than a potential of the first conductive film. A drive voltage Vf [V] is applied between the first conductive film and the second conductive film so that a potential of the second conductive film is higher than the potential of the first conductive film, to emit electrons from the first conductive film.

A thickness of a first portion of the second conductive film, which is located at a shortest distance d from a portion of the first conductive film from which electrons are emitted by applying the drive voltage Vf [V] to the electron-emitting device, is equal to or smaller than the thickness of the portion of the first conductive film from which the electrons are emitted. The shortest distance d is smaller than $(Vf \times H)/(\Pi \times Va)$, and the second conductive film has a second portion and a third portion, between which the first portion is arranged. The second portion and the third portion of the second conductive film are thicker than the first portion.

According to this invention, an electron-emitting device having an improved electron emission efficiency and an electron-emitting apparatus that uses such an electron-emitting device are provided. As a result, an image display device that maintains superior image display quality for an extended period of time and an information display/reproduction apparatus that uses this display device can be provided.

Furthermore, according to the electron-emitting apparatus of the invention, since the equipotential line, in the vicinity of the electron-emitting portion of the first conductive film, that corresponds to half (0.5 Vf) of the voltage (Vf) applied between the first and second conductive films is inclined toward the first conductive film, the trajectory of electrons emitted from the electron-emitting portion is changed. As a result, the emission current Ie that reaches the anode is increased (the electron emission efficiency is increased). For example, since the second portion and the third portion are higher than a portion of the first conductive film end which faces the first portion, the equipotential line corresponding to half of the applied voltage (Vf) may be inclined toward the first conductive film by an electric field caused by shapes of the second and third portions. As a result, the emission current Ie reaching the anode is increased (efficiency is increased).

Further features and advantages of the present invention will become apparent from the following description of exemplary embodiments (with reference to the attached drawings).

DESCRIPTION OF THE SYMBOLS

| | |
|---|---|
| 1: | substrate |
| 8: | gap |
| 21a: | first conductive film |
| 21b: | second conductive film |
| 33: | first portion |
| 35: | second portion |
| 36: | third portion |

DESCRIPTION OF THE EMBODIMENT

One embodiment of the present invention will now be described. First, an example basic structure for an electron-emitting device according to the present invention will be explained while referring to FIG. 1.

Figure 1:
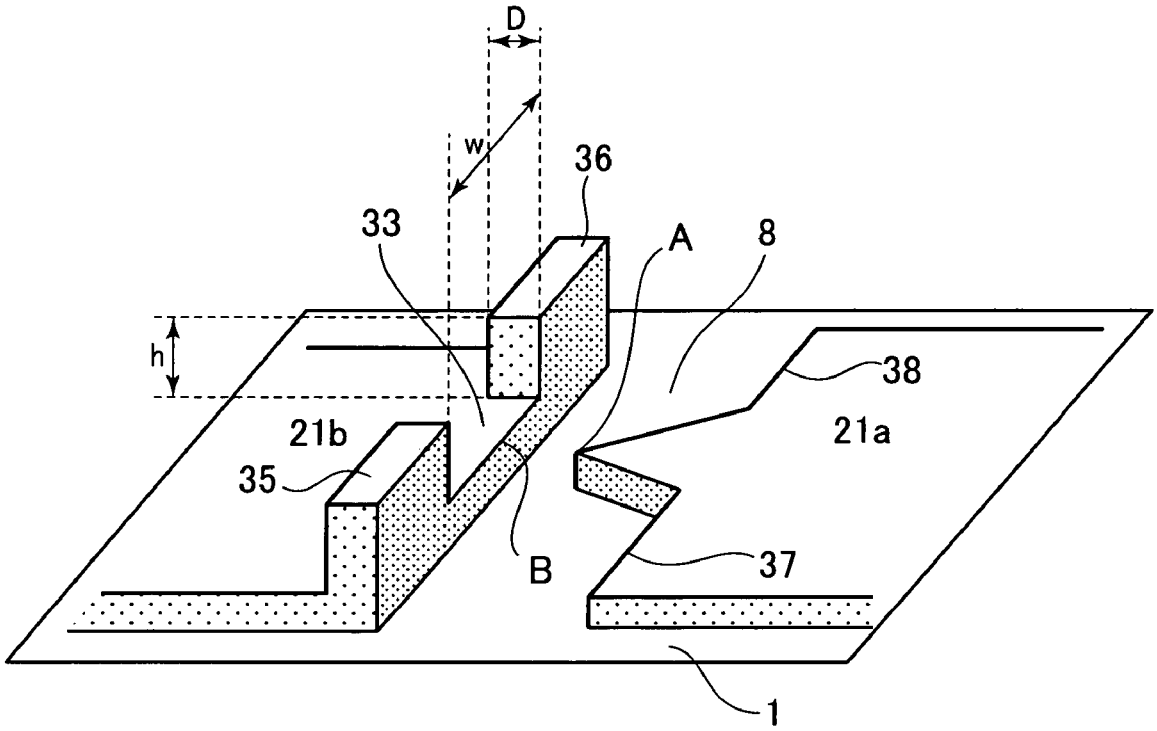
FIG. 1 is a schematic perspective view of an example structure for an electron-emitting device according to the present invention.

FIG. 1 is a schematic perspective view of at least part of the electron-emitting device of the invention. A plurality of the structures shown on substrate 1 in FIG. 1 may be included in the electron-emitting device of the invention on the substrate 1, and actually, it is preferable that a plurality of the structures be included.

In FIG. 1, reference numeral 1 denotes the substrate, reference numeral 21*a* denotes a first conductive film, reference numeral 21*b* denotes a second conductive film, and reference numeral 8 denotes a gap between the first conductive film 21*a* and the second conductive film 21*b*. First, second, third, fourth and fifth portions 33, 35, 36, 37 and 38, respectively, are parts of the second conductive film 21*b* (portions 33, 35, 36) and the first conductive film 21*a* (portions 37 and 38). An end A of the first conductive film 21*a* and an end B of the second conductive film 21*b* are opposite each other. A gap between the first conductive film end A and the second conductive film end B is narrower than at other areas. Accordingly, an electric field between the first conductive film end A and the second conductive film end B is generally stronger than that at other portions between the first and the second conductive films. The portion A (the first conductive film end A) can be described as an electron-emitting portion, and the portion B (the second conductive film end B) can be described as a portion of the second conductive film 21*b* nearest the portion A. The distance between the portion A and the portion B is defined as "d".

Therefore, the distance d between the first portion 33 (corresponding to the portion B) of the second conductive film 21*b* and the opposite portion A of the first conductive film 21*a* is smaller than the distance between the fourth portion 37 of the first conductive film 21*a* and the second portion 35 of the second conductive film 21*b*, and is also smaller than the distance between the fifth portion 38 of the first conductive film 21*a* and the third portion 36 of the second conductive film 21*b*.

The thickness of the first portion 33 (corresponding to the portion B) of the second conductive film 21*b* is smaller than the thicknesses of the second portion 35 and the third portion 36 of the second conductive film 21*b*. Since the second portion 35 and the third portion 36 of the second conductive film 21*b* are farther from the surface of the substrate 1, unlike the other portions of the second conductive film 21*b*, these portions can also be called "projected portions" or "prominent portions".

Because of this structure, there is a difference "h" (or the height "h" of the projected portions) between the heights of each of the second and the third portions 35 and 36 of the second conductive film 21*b*, measured from the surface of the substrate 1, relative to the height of the first portion 33 (portion B), measured from the surface of the substrate 1.

At least two "projected portions" 35 and 36 are present on the second conductive film 21*b*, and there is a gap "w" between them. The gap "w" can practically be defined as a distance between the points (tops or apexes or summits) of the projected portions 35 and 36 that are farthest from the surface of the substrate 1.

It is preferable that practically the gap w between the projected portions be set equal to or greater than 2d and equal to or smaller than 50d, because within this range, a high emission current Ie and a high electron emission efficiency can be obtained.

The height "h" of the projected portions 35 and 36 can actually be defined as a value obtained by subtracting the shortest distance between the portion B and the surface of the substrate 1 from the shortest distance between the surface of the substrate 1 and the farthest point (the top or apex or summit) of one of the projected portions 35 and 36. It is preferable that the height h of the "projected portion" 35 or 36 effectively be set equal to or greater than 2d and equal to or smaller than 200d, because within this range a high emission current Ie and a high electron emission efficiency can be obtained. When the heights of the projected portions 35 and 36 differ, the above-described condition need only be established for the lowest projected portion.

As will be described later, the electron-emitting device of the invention may further include: a first electrode 4*a* connected to the first conductive film 21*a*, for supplying a potential to the first conductive film 21 a; and a second electrode 4*b* connected to the second conductive film 21*b*, for supplying a potential to the second conductive film 21*b*.

Furthermore, for the electron-emitting device of the invention, part of the outer edge (or border) of the gap 8 can be regarded as being formed by the portion A and the portion B. The fourth portion 37 and the fifth portion 38 of the first conductive film 21*a* and the second portion 35 and the third portion 36 of the second conductive film 21*b* may be also regarded as a part of the outer edge (or border) of the gap 8.

An explanation will now be given for an operation for driving the electron-emitting device of this invention. For example, as is shown in a schematic diagram in FIG. 6, an electron-emitting device (constituted by components 21*a*, 21*b*, 4*a* and 4*b*) is arranged facing an anode electrode 44 and is driven in a vacuum (vacuum container 23). Since the anode electrode 44 is located at a distance H [m] above the electron-emitting device, an electron-emitting apparatus is obtained. A drive voltage Vf [V] is applied between the first conductive film 21*a* and the second conductive film 21*b*, so that the potential of the second conductive film 21*b* is higher, while at the same time, a voltage Va [V] is applied between the anode electrode 44 and the first conductive film 21*a*, so that the potential of the anode 44 is higher than the potentials of the first and the second conductive films 21*a* and 21*b* (typically, the potential of the first conductive film 21*a*). As a result, an electric field is generated at the gap 8 between the end of the first conductive film 21*a* and the end of the second conductive film 21*b*. When the electric field generated at the gap 8 is set to an appropriate strength for the tunneling of electrons, electrons are preferentially tunneled from the end (e.g., the portion A in FIG. 1) of the first conductive film 21 a located nearest the end of the second conductive film 21*b*, and at least some of these electrons reach the anode electrode 44.

The effective field strength used for driving (electron emission) the electron-emitting device of the invention (the field strength applied between the first conductive film 21*a* and the second conductive film 21*b*) is preferably equal to or greater than $1\times10^{9}$ V/m and less than $2\times10^{10}$ V/m. When the field strength falls below this range, the number of electrons tunneled is tremendously reduced, and when the field strength rises beyond this range, the first conductive film 21*a* and/or the second conductive film 21*b* may be deformed by the strong electric field, and unstable electron emission tends to occur.

Figure 21:
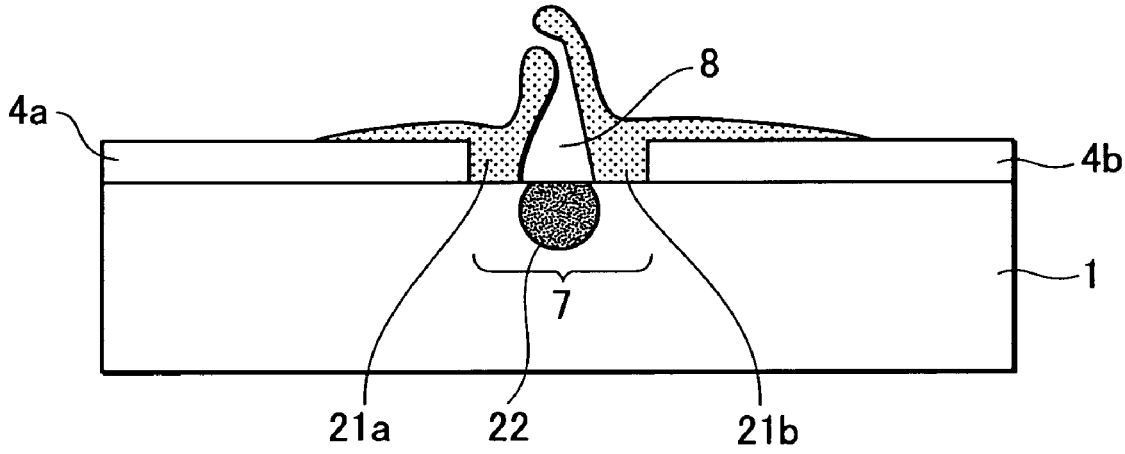
FIG. 21 is a schematic cross-sectional view of an example conventional electron-emitting device.

Compared with the electron-emitting device in FIG. 21 that does not have the second portion 35 and the third portion 36, the electron-emitting device in FIG. 1 can reduce the number of electrons absorbed by the second conductive film 2*b*. As a result, the electron emission efficiency (the current (Ie) that reaches the anode/the current (If) that flows across the first conductive film 21*a* and the second conductive film 21*b*) can be considerably increased. This occurs because the electrons (including electrons scattered near the first portion B) that have been tunneled from the portion A to the first portion B are strongly affected by an electric field generated due to the shapes of the second portion 35 and the third portion 36, and are moved in a direction away from the surface of the substrate 1.

Figure 2A:
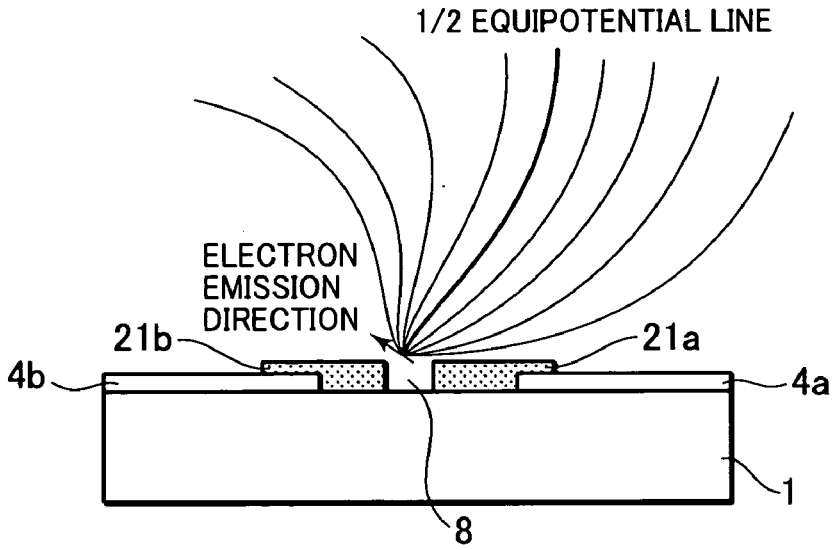
FIGS. 2A to 2C are schematic cross-sectional views of the electron-emitting portion of the electron-emitting device showing example equipotential lines according to the invention.

In FIG. 2A, the equipotential lines are schematically shown in a cross section, perpendicular to the surface of the substrate 1, that extends across the first portion B of the second conductive film 21*b* and the opposing portion A of the first conductive film 21*a* in FIG. 1. In other words, in FIG. 2A, the equipotential lines are schematically shown in the cross section that includes the electron-emitting portion of the electron-emitting device of the invention.

Figure 2B:
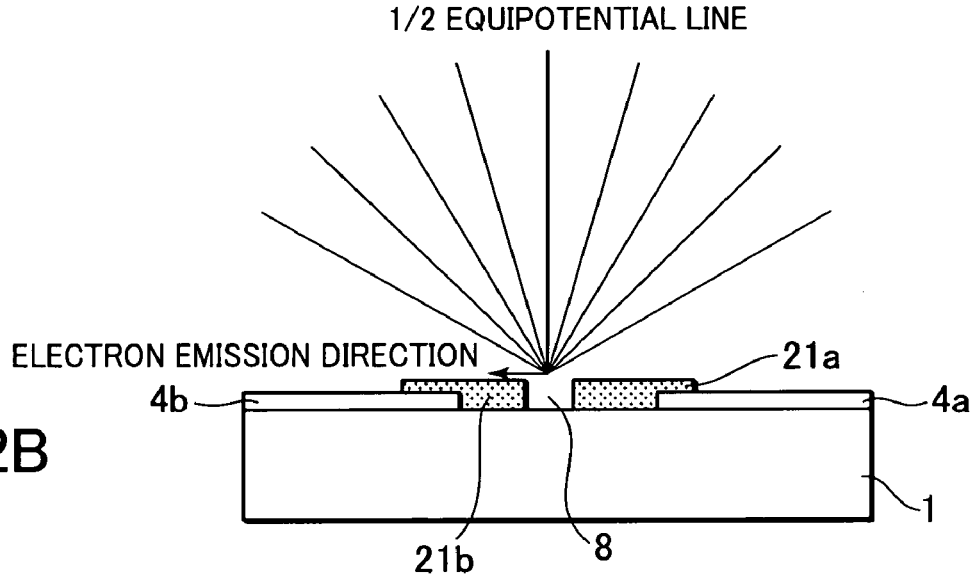
Figure 2C:
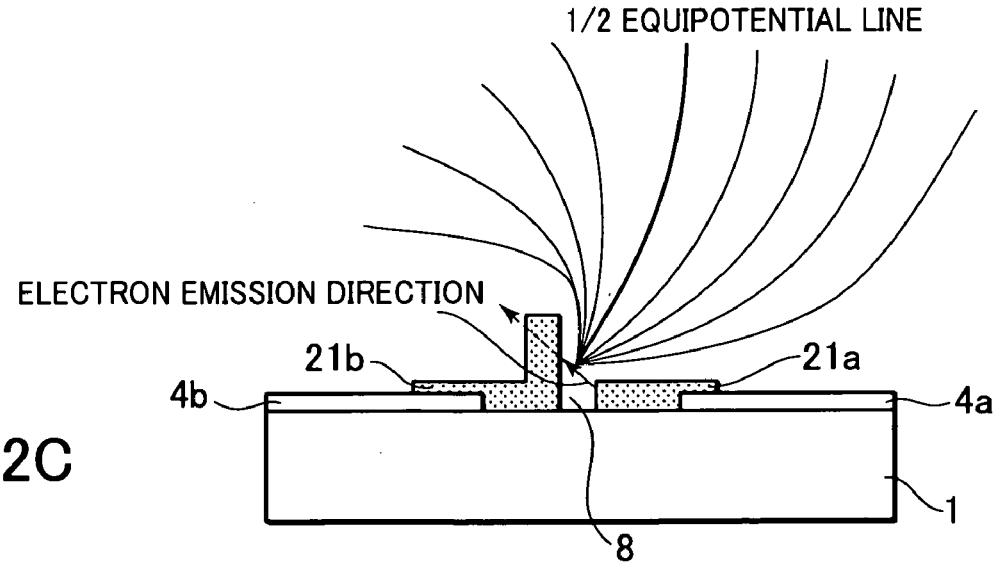

In FIG. 2C, the equipotential lines are schematically shown in a cross section, perpendicular to the surface of the substrate 1, that extends across the fourth portion 37 of the first conductive film 21*a* and the second portion 35 of the second conductive film 21*b* in FIG. 1.

In lieu of an explanation that will be given later, in the cross section in FIG. 2C, a solid-line arrow representing an "electron emission direction" is additionally provided parallel to an arrow representing an "electron emission direction" in FIG. 2A. This does not mean that electrons are emitted in the direction indicated by this arrow by the portions 37 and 38 of the first conductive film 21*a* located in the cross section in FIG. 2C.

An arrow indicated by a broken line in FIG. 2C represents an extension of the solid-line arrow. The length of the second conductive film 21*b* that intersects (overlaps) the broken-line arrow corresponds to the "thickness of the second conductive film 21*b* present in the direction in which electrons are emitted" (in the following embodiment, corresponding to the "thickness of a second carbon film 21*b* present in a direction in which a portion A of the first carbon film 21*a* and a portion B of the second carbon film 21*b* are opposite each other" (a direction in which electrons are emitted)).

Since the conductive films 21*a* and 21*b* are very thin, the "thickness of the second conductive film 21*b* present in the direction in which electrons are emitted" can be substantially identified by "depths" D, as denoted in FIG. 1 of the "projected portions" 35 and 36.

When the "depth" is not constant in heights of the "projected portion", for example, when the "depths" of the "projected portions" 35 and 36 are reduced as these portions are more distant from the surface of the substrate 1, the "thickness of the second conductive film 21*b* present in the direction in which electrons are emitted" or the "depths" of the "projected portions" 35 and 36 can further be identified by "the length of the second conductive film 21*b* in the direction in which the first and the second conductive films 21*a* and 21*b* face each other on the surface of the substrate 1. this length is, for example, a third plane that is parallel to the surface of the substrate 1 and is positioned between a first plane, which is parallel to the surface of the substrate 1 and which includes the apex (top or summit or proximal end) of either the "projected portion" 35 or 36 farthest from the surface of the substrate 1, and a second plane, which is parallel to the surface of the substrate 1 and which includes the portion A of the first conductive film 21*a*. When the heights of the projected portions 35 and 36 differ, the first plane need only includes the lower projected portion apex.

It is preferable that the third plane be positioned midway between the first plane and the second plane (the same distance from the first plane as from the second plane). Further, as will be described later, when the electron-emitting device of the invention includes a first electrode 4*a* and a second electrode 4*b* (or a first auxiliary electrode 2 and a second auxiliary electrode 3), the "direction in which the first conductive film 21*a* and the second conductive film 21*b* face each other on the surface of the substrate 1 " can be replaced with a direction in which the first electrode 4*a* and the second electrode 4*b* face each other (or the first auxiliary electrode 2 and the second auxiliary electrode 3 face each other).

When the distance between the portions A and B in FIG. 1 is defined as d, it is preferable that the effective depth "D" be set equal to or smaller than 200d. And practically, from the viewpoint of the structural and potential stability of the projected portions 35 and 36, the depth "D" is preferably equal to or greater than 5 nm.

In FIGS. 2A and 2C, equipotential lines are shown that are formed when a drive voltage Vf [V] is applied between the second conductive film 21*b* and the first conductive film 21*a* so that the potential of the second conductive film 21*b* is higher than that of the first conductive film 21*a*.

Furthermore, FIG. 2B is a schematic cross-sectional view of an electron-emitting device wherein neither the second portion 35 nor the third portion 36 are present, and wherein opposed portions of the first conductive film 21*a* and the second conductive film 21*b*, extended along the sides of the intervening gap 8, have substantially the same thickness. In FIG. 2B, the equipotential lines are shown in the cross section, at least perpendicular to the surface of the substrate 1, that extends across the first conductive film 21*a* and the second conductive film 21*b*. In FIG. 2B as in FIGS. 2A and 2C, these equipotential lines are formed when a drive voltage Vf [V] is applied between the second conductive film 21*b* and the first conductive film 21*a* so that the potential of the first conductive film 21*a* is higher than that of the second conductive film 21*b*.

The equipotential lines in FIGS. 2A to 2C are formed by applying a drive voltage Vf [V] to the second conductive film

Figure 6:
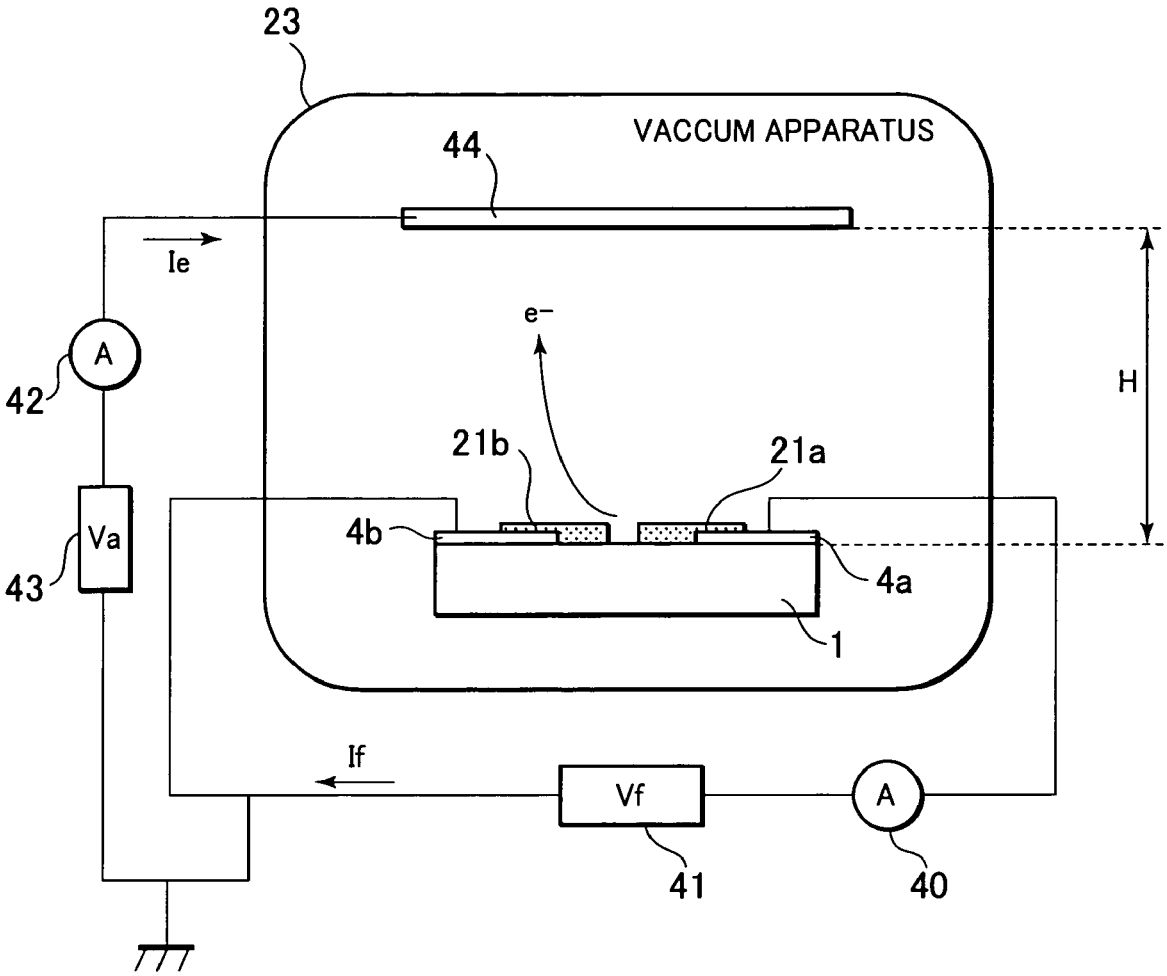
FIG. 6 is a schematic diagram showing an example vacuum apparatus having a function for measuring and evaluating the electron-emitting device.

21*b* and the first conductive film 21*a* when, for example, unlike in FIG. 6, the anode electrode 44 is not located above the electron-emitting device, or when the anode electrode 44 is located above the electron-emitting device at the distance H [m] and no potential difference exists between the anode electrode (44) and the conductive films (21*a* and 21*b*). That is, in FIGS. 2A to 2C are shown the equipotential lines that are formed when the drive voltage Vf [V] is applied, between the second conductive film 21*b* and the first conductive film 21*a*, under a condition wherein the affect of the anode electrode 44 potential on the equipotential lines near the gap 8 can substantially be ignored.

In the electron-emitting apparatus shown in FIG. 6, and in an image display device that will be described later, a drive voltage Vf [V] is applied to the electron-emitting device while a voltage Va [V], within a range that will be described later, is applied to the anode electrode 44 located above the electron-emitting device at the distance H [m]. Therefore, to provide a more exact description, when the electron-emitting apparatus or the image display device that will be described later is driven, the form of the equipotential lines in an area away from the electron-emitting portion are affected by the potential of the anode electrode 44, and differs from those in FIGS. 2A to 2C.

However, for both the electron-emitting apparatus and the image display device that will be described later, the strength of the electric field generated between the anode electrode 44 and the electron-emitting device is typically equal to or less than 1/10 the strength of the electric field generated between the first and the second conductive films 21*a* and 21*b* (applied to the gap 8). Accordingly, an electric field in the vicinity of the electron-emitting portion (the vicinity of the gap 8) is adversely affected little by the potential of the anode electrode 44. Therefore, the equipotential lines in the vicinity of the gap 8 having basically the same forms as in FIGS. 2A to 2C are obtained. It should be noted that when the distance between the portion A and the portion B in FIG. 1 is d, the vicinity of the electron-emitting portion can be effectively defined as a circle, having a radius of 50d, for which the portion A of the first conductive film 21*a* is the center. Further, the distance H [m] is the distance between the anode electrode 44 and the electron-emitting device, and can effectively be regarded as being equal to the distance from the surface of the substrate 1, where the electron-emitting device is located, to the anode electrode 44.

Furthermore, FIGS. 2A to 2C show a case where the first electrode 4*a*, for connecting to and for supplying the potential to the first conductive film 21*a*, and the second electrode 4*b*, for connecting to and for supplying the potential to the second conductive film 21*b*, are provided. In this case, the first and the second electrodes 4*a* and 4*b* are each formed of a single conductor. However, the electrodes 4*a* and 4*b* may be replaced with electrodes constituted by a plurality of conductive films connected each other. In addition, a first auxiliary electrode (not shown) connected to the first electrode 4*a* and a second auxiliary electrode (not shwon) connected to the second electrode 4*b* may also be provided.

For the electron-emitting device of this invention, as is shown in FIG. 2A, when a drive voltage is applied between the first conductive film 21*a* and the second conductive film 21*b*, an equipotential line ("½ equipotential line" in FIG. 2A) representing half (a voltage difference) the drive voltage is inclined toward the first conductive film 21*a* (and can be described as, "being tilted toward the first conductive film 21*a*" or "deviated toward the first conductive film 21*a*"). Therefore, an upward force (in a direction away from the substrate 1) is exerted on the electrons emitted from the first conductive film 21*a* side, and the number of electrons being absorbed to the second conductive film 21*b* side can be reduced, i.e., the number of electrons that reach the anode electrode 44 can be increased.

On the other hand, for an electron-emitting device wherein the second portion 35 and the third portion 36 described above are not present, as is shown in FIG. 2B, the "½ equipotential line" is located almost in the middle of the first and the second conductive films 21*a* and 21*b*, i.e., substantially perpendicular to the surface of the substrate 1. Therefore, compared with the electron-emitting device shown in FIG. 2A, the number of electrons being absorbed to the second conductive film 21*b* side is increased.

Furthermore, for the electron-emitting device of the invention, as is described above, at the portions (the portion A and the portion B in FIG. 1) whereat the gap between the first conductive film 21*a* and the second conductive film 21*b* is narrower than at other areas, it is preferable that the thickness of the second conductive film 21*b* (the thickness of the portion B) is set to be equal to or smaller than the thickness of the first conductive film 21*a* (the thickness of the portion A) (more preferably, smaller than the thickness of the portion A).

With this arrangement, the probability that the electrons emitted (tunneled electrons) from a portion where the electrons must be emitted (corresponding to the portion A in FIG. 1) will collide with (will be absorbed to) the second conductive film 21*b* side can be reduced. As a result, further improvement of the electron emission efficiency can be realized. According to the conventional electron-emitting device as shown in FIG. 21, it seems that the thickness of the end portion (corresponding to the portion B of the electron-emitting device of this invention) of the second conductive film 21*b* that forms the outer edge of the gap 8 is greater than the thickness of the end portion (corresponding to the portion A of the electron-emitting device of this invention) of the first conductive film 21*a* that forms the outer edge of the gap 8. Thus, of the electrons emitted from the first conductive film 21 a side, the number of electrons regarded as an ineffective current (device current If), due to electrons being absorbed to or scattered at the second conductive film 21*b* side, will be greater than that for the electron-emitting device of this invention. Further, for the electron-emitting device of the invention, depending on the material for the first and the second conductive films 21*a* and 21*b*, the distance d between the portions A and B in FIG. 1 is preferably equal to or shorter than 50 nm, more preferably equal to or shorter than 10 nm, and most preferably equal to or shorter than 5 nm. It is preferable that the lower limit of the distance d be equal to or higher than 1 nm in view of a controllability of ON and OFF for electron emission and in view of a controllability of the amount of electrons to be emitted. When the drive voltage Vf is too high, the creeping discharge (discharge breakdown) phenomenon tends to occur on the surface of the substrate 1 near the gap 8. Especially for the range of the distance d described above, when a drive voltage is beyond 50 V, damage can be possible to the electron-emitting device due to the creeping discharge. Therefore, for the range of the distance d, it is preferable that the practical drive voltage Vf [V] be equal to or higher than 10 V and equal to or lower than 50 V. It should be noted that the distance d and the drive voltage Vf satisfy the above-described range of the strength of the electric field.

To drive the electron-emitting device of this invention, as shown in FIG. 6 for the schematic configuration, the electron-emitting device is located opposite the anode electrode 44, and is driven in a vacuum (vacuum container 23). By arranging the anode electrode 44 above the electron-emitting device, an electron-emitting apparatus is provided. In FIG. 6, numeral 1 denotes a substrate, the first and second conductive films 21*a* and 21*b* are arranged; numeral 23 denotes a vacuum container; numeral 41 denotes a power source, for applying a drive voltage Vf; numeral 40 denotes an ammeter, for measuring a device current If that flows between the first conductive film 21*a* and the second conductive film 21*b*; numeral 44 denotes an anode electrode; numeral 43 denotes a high voltage power source, for applying a voltage Va to the anode electrode 44; and numeral 42 denotes an ammeter, for measuring an emission current Ie. The electron-emitting device and the anode electrode 44 are located inside the vacuum apparatus. In this case, the first electrode 4*a* connected to the first conductive film 21*a* and the second electrode 4*b* connected to the second conductive film 21*b* are employed for stably supplying the potential to the first and second conductive films 21*a* and 21*b*. However, these electrodes 4*a* and 4*b* are not requisite components for the electron-emitting device of this invention.

Assume that H [m] denotes the distance between the substrate 1 in FIG. 6 and the anode 44, which is separate from the substrate 1, Va [V] denotes a voltage applied to the anode electrode 44 (typically a difference between the potential of the first conductive film 21*a* and the potential of the anode electrode 44), and Vf [V] denotes a voltage (drive voltage) applied between the first and the second conductive films 21*a* and 21*b* when the electron-emitting device is driven. When the distance d [m] between the portion A and the portion B in FIG. 1 is set larger than $Xs=(Vf\times H)/(\Pi\times Va)$, the effects obtained by the potentials at the second portions 35 and the third portions 36 may be reduced. Therefore, the distance d [m] is preferably not larger than the Xs. Further, preferably, the practical distance H is set equal to or longer than 100 μm and equal to or shorter than 10 mm, and more preferably equal to or longer than 1 mm and equal to or shorter than 3 mm. The voltage Va is equal to or higher than 1 kV and is equal to or lower than 30 kV, and more preferably, is equal to or higher than 7 kV and is equal to or lower than 20 kV. Thus, according to the invention, electrons are emitted while the field strength generated between the portions A and B in FIG. 1 (synonymous with the field strength applied between the first and second conductive films 21*a* and 21*b*) is higher than the field strength between the anode electrode 44 and the first conductive film 21*a*. In order to perform more stable electron emission, it is preferable that the field strength between the anode electrode 44 and the first conductive film 21*a* is set to be lower by equal to or more than two tens of units than the field strength between the portions A and B.

Referring to FIG. 1, the first and the second conductive films 21*a* and 21*b* are opposite each other, in a direction parallel to the surface of the substrate 1, and are separated completely, with the gap 8 serving as the boundary. However, according to the invention, the first and the second conductive films 21*a* and 21*b* may be partially connected, i.e., the gap 8 may be formed in a part of one of those conductive films. That is, ideally, the conductive films are separated completely; however, so long as a satisfactory electron emission characteristic is obtained, the first conductive film 21*a* and the second conductive film 21*b* may be slightly connected.

The substrate 1 can be, for example, a silica glass plate, a soda lime glass plate, or a soda lime glass plate whereon oxide silicon (specifically $SiO_2$) is laminated using a well-known film deposition method, such as a sputtering method. As is described above, in this invention, a material containing silicon oxide (specifically $SiO_2$) is preferably employed for the substrate.

Both the first conductive film 21*a* and the second conductive film 21*b* may be formed of an electroconductive film comprising an electroconductive material such as Ni, Au, PdO, Pd, Pt or carbon. It is especially preferable that these films (21*a*, 21*b*) contain carbon (made of carbon films) because a large number of electrons can be emitted and greater stability can be maintained over time. Further, it is preferable, as a practical range, that the films (21*a*, 21*b*) contain equal to or greater than 70 atm % of carbon.

Further, as will be described later while referring to FIG. 3, it is preferable, for the electron-emitting device of the invention, that the surface of the substrate 1 has a recessed portion at the gap 8, between the first and the second conductive films 21*a* and 21*b*. By forming the recessed portion, an ineffective current flowing between the first and the second conducive films (21*a*, 21*b*) can be suppressed. An undesirable discharge such as the discharge breakdown between the first and second conductive films (21*a*, 21*b*) and through the surface of the substrate 1 can also be suppressed.

In addition, as will be described later while referring to FIG. 3, for the electron-emitting device of this invention it is preferable that the gap between the first and the second conductive films (21*a*, 21*b*) at a elevated location, above the surface of the substrate 1, be smaller than the gap between the films (21*a*, 21*b*) at the surface of the substrate 1. With this arrangement, the ineffective current and the undesirable discharge between the first and the second conductive films (21*a*, 21*b*) may be more effectively suppressed.

Figure 3A:
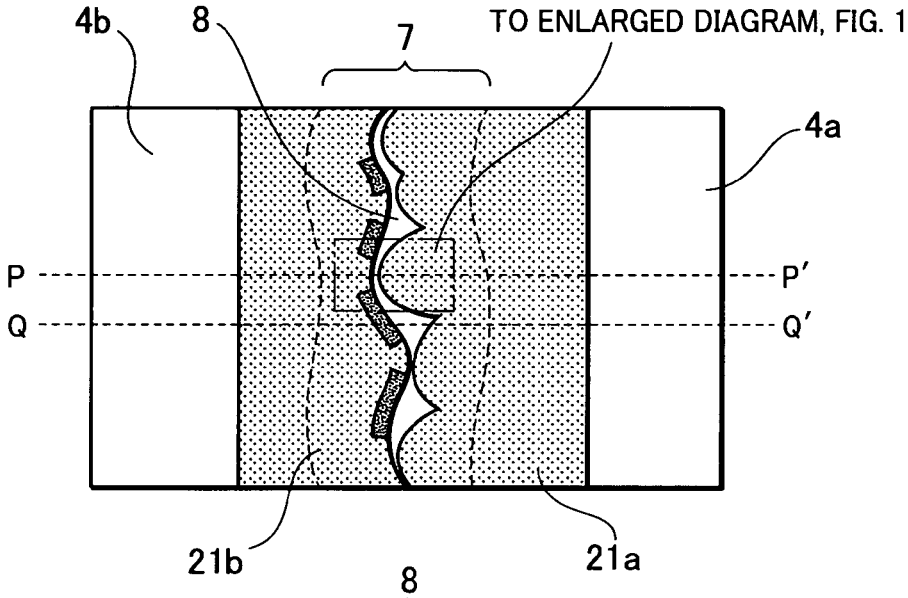
FIGS. 3A to 3C are a schematic plan view and schematic cross-sectional views of another example structure for the electron-emitting device of the invention.
Figure 3B:
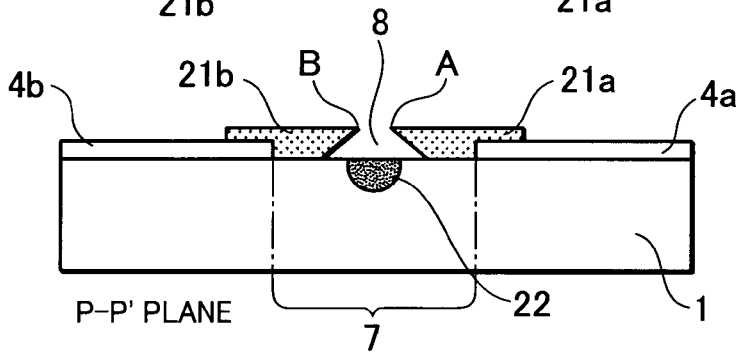
Figure 3C:
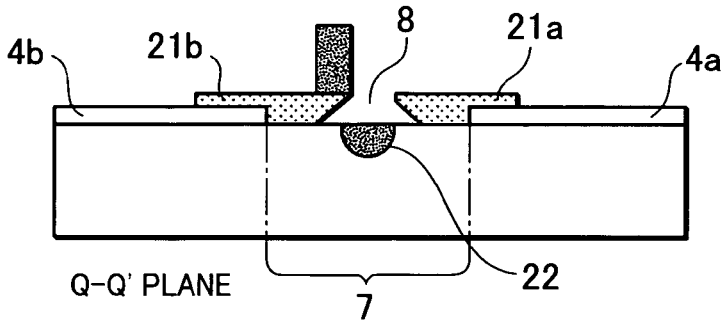

A modification of the electron-emitting device of this invention will now be explained while referring to FIGS. 3A to 3 C. In FIGS. 3A to 3C, an electron-emitting device having the multiple component structures shown in FIG. 1 is provided. FIG. 3A is a schematic plan view of a modification of the electron-emitting device of the invention. FIG. 3B is a schematic cross-sectional view taken along line P-P' in FIG. 3A, and FIG. 3C is a schematic cross-sectional view taken along Q-Q' in FIG. 3A. In FIG. 3A, the structure in a rectangular region defined by broken lines is simillar to the structure as shown in FIG. 1. That is, dark gray areas in FIG. 3A correspond to the projected portions 35 and 36 of the second conductive film 21*b* explained while referring to FIG. 1. As is described above, for the electron-emitting device of this invention, the end (circumference) of the second conductive film 21*b* near the first conductive film 21*a* is not limited to the linear shape shown in FIG. 1. Further, the ends (circumferences) of the first and the second conductive films 21*a* and 21*b* facing each other may be curved. Preferably, from the viewpoint of the structural stability, the ends (circumferences) of the first and the second conductive films 21*a* and 21*b* are curved.

According to the structure shown in FIGS. 3A to 3C, the first electrode 4*a*, connected to the first conductive film 21*a*, and the second electrode 4*b*, connected to the second conductive film 21*b*, are employed to supply a stable potential to the first and the second conductive films 21*a* and 21*b*. However, these electrodes 4*a* and 4*b* need not always be employed. In addition, in this modification, the first and the second conductive films 21*a* and 21*b* are preferably carbon films (a first carbon film 21*a* and a second carbon film 21*b*).

In FIGS. 3A to 3C, numeral 1 denotes the substrate; numeral 4 a denotes the first electrode; numeral 4*b* denotes the second electrode; numeral 21*a* denotes the first carbon film, corresponding to the first conductive film of FIG. 1; numeral 21*b* denotes the second carbon film, corresponding to the second conductive film of FIG. 1; and numeral 22 denotes a recessed portion. The portions A and B represent the location of the narrowest gap (the strongest electric field), explained while referring to FIG. 1. In the example in FIG. 3B, the gap between the first and the second carbon films 21*a* and 21*b*, above the surface of the substrate 1, is narrower than the gap between these films 21*a* and 21*b* at the surface of the substrate 1.

The first electrode 4*a* and the second electrode 4*b* are opposite each other, in a direction parallel to the surface of the substrate 1, and are completely separated by an intervening second gap 7, which serves as a boundary. However, in some embodiments, small areas of the electrodes 4*a* and 4*b* may be connected. When one conductive film is divided to form the first and the second electrodes 4*a* and 4*b*, as in a "forming process" that will be described later, the second gap 7 may also be described as "a second gap 7 formed in part of the conductive film". That is, it is ideal for the two films (4*a*, 4*b*) to be completely separated; however, so long as a satisfactory electron emission characteristic is obtained, the first and the second electrodes (4*a*, 4*b*) may be connected in a minute area. Further, wiring and auxiliary electrodes (not shown in FIG. 3A to 3C) for supplying a voltage may be additionally connected to the first and the second electrodes (4*a*, 4*b*) respectively.

It is preferable that, as is shown in FIGS. 3A to 3C, the first and the second carbon films (21*a*, 21*b*) be arranged at least paetially on the first and the second electrodes (4*a*, 4*b*) and be arranged at least paetially on a surface of the substrate 1 located in the second gap 7. With this arrangement, the first and the second carbon films 21*a* and 21*b* are electrically connected to the first and the second electrodes 4*a* and 4*b*, respectively. When the first and the second electrodes 4*a* and 4*b* are thin films, the poetions of the electrodes near the gap 8 are preferably covered with carbon films (21*a*, 21*b*) to suppress their deformation by jule heating and the like. In FIGS. 3A to 3C, the first carbon film 21*a* and the second carbon 21*b* are opposite each other, in a direction parallel to the surface of the substrate 1, and are completely separated by the first gap 8. However, in other embodiments, these carbon films may be partially connected in a minute region. That is, the structure shown in FIG. 3A to 3C may also be called "a carbon film having the first gap 8". Ideally, the first carbon film 21*a* and the second carbon film 21*b* are completely separated, but so long as an adequate electron emission characteristic is obtained, the first and the second carbon films (21*a*, 21*b*) may be connected in a minute region.

A selected conductive material can be employed for the first and the second electrodes 4*a* and 4*b*. For example, a metal such as Ni, Cr, Au, Mo, W, Pt, Ti, Al, Cu, Pd, or an alloy of them, a transparent conductor such as $In_2O_3$—$SnO_2$, or a semiconductor such as polysilicon may be used for the conductive material.

Figure 22A:
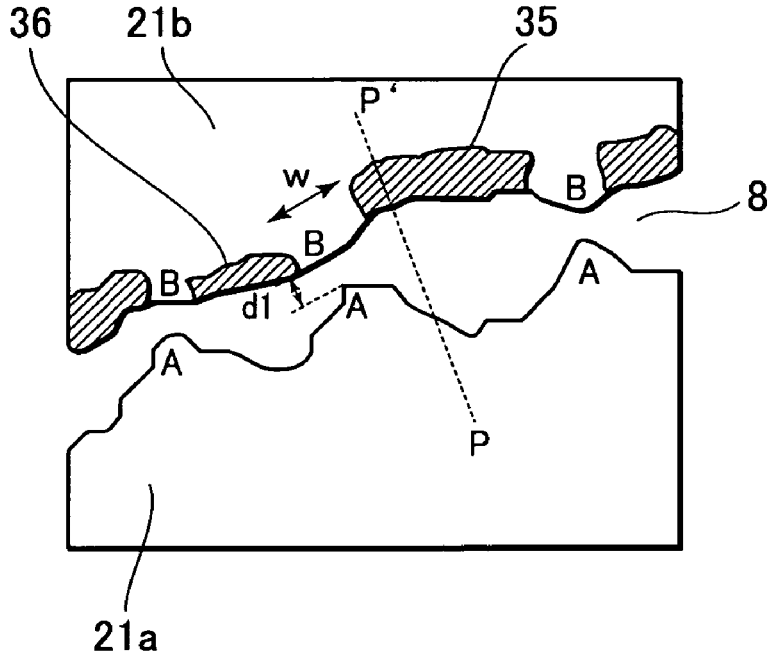
FIGS. 22A to 22C are schematic diagrams showing an example mode for the electron-emitting device according to the invention.
Figure 22B:
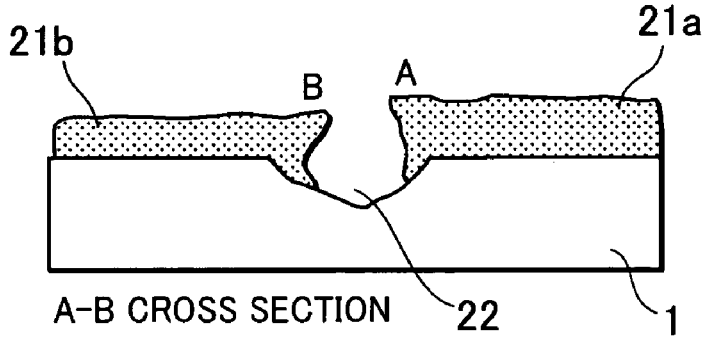
Figure 22C:
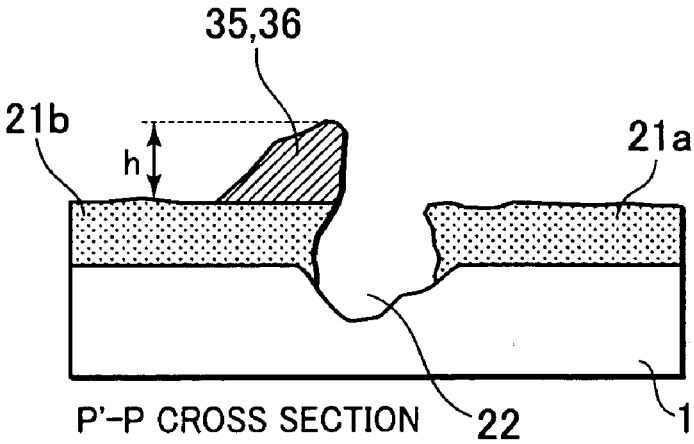

It is especially preferable that the electron-emitting device of this invention has a structure (or structures) schematically shown in FIGS. 22A to 22C. FIGS. 22A to 22C schematically show enlarged views of a part of an electron-emitting device. FIG. 22A is a schematic plan view in the vicinity of the gap 8, and FIG. 22B is a schematic cross-sectional view along an A-B line in FIG. 22A. FIG. 22C is a schematic cross-sectional view taken along line P-P' in FIG. 22A. The same reference numerals used in FIGS. 1 and 3 are also employed to denote corresponding components in FIGS. 22A to 22C. Furthermore, in the example in FIGS. 22A to 22C, the first conductive film 21*a* and the second conductive film 21*b* are carbon films. As is shown in FIGS. 22A to 22C, the first and the second conductive films 21*a* and 21*b* of the electron-emitting device of this invention are not necessarily limited to the polygonal shape that is composed of planes, as is shown in FIGS. 1, 3A to 3C. Indeed, in other embodiments, the surface (outer shape) of the first and the second conductive films (21*a*, 21*b*) can be composed of a curved surface (surfaces) or a complicated surface consisting of curved surfaces and planes. It is also preferable that, as is shown in FIGS. 22B and 22C, the conductive films 21*a* and 21*b* may be partially formed in the recessed portion. The heights of the projected portions 35 and 36 that sandwich the portion B may differ. It should be noted that, the "projected portion" (35, 36) and the conductive films (21*b*, 22*c*) are distinctly shown in FIGS. 3*a*, 3*c*, 5*a*, 5*b*, 22*a* and 22C to facilitate understanding of the structure. Accordingly, materials or compositons of the "projected portion" (35, 36) and the conductive films (21*b*, 22*c*) are not necessarilly different from each other in those drawings.

Various methods for manufacturing the electron-emitting device of the invention can be employed. For example, the following steps, (1) to (5), may be employed for the manufacturing process.

Figure 7A:
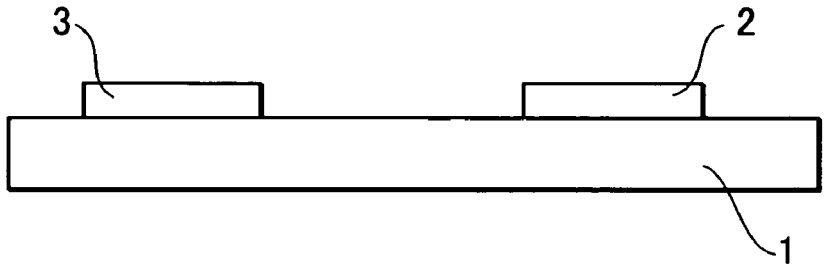
FIGS. 7A to 7D are schematic cross-sectional views represently the result of steps of a manufacturing method according to the invention.
Figure 7B:
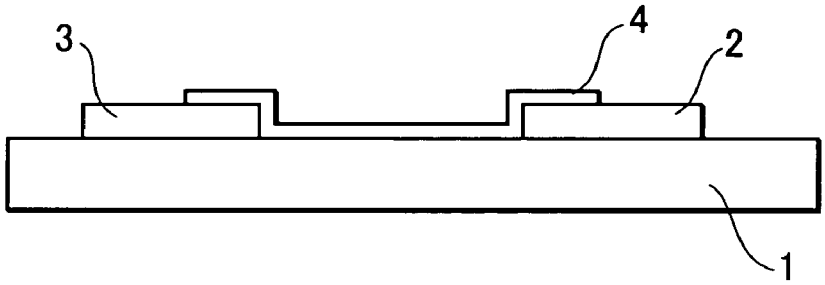
Figure 7C:
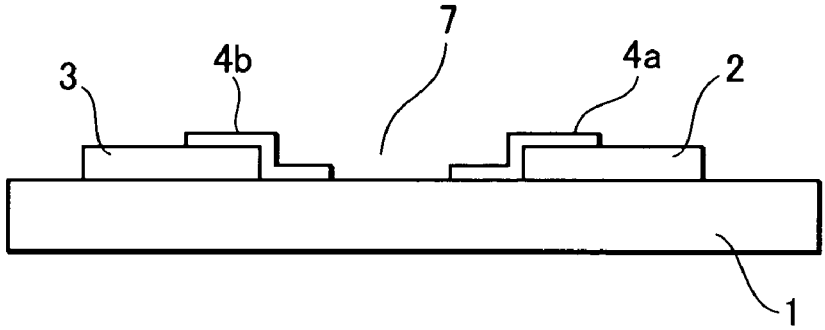
Figure 7D:
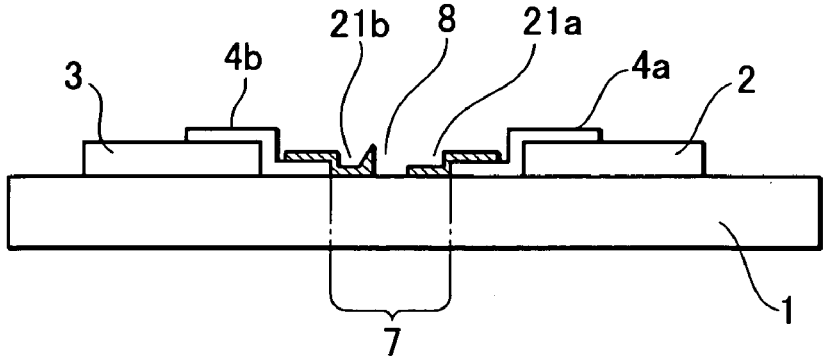

An example manufacturing method will now be described while referring to FIGS. 1, 3 and 6 to 10. In the following example, carbon films are employed as the first conductive film 21*a* and the second conductive film 21*b*, and the first auxiliary electrode 2 is connected to the first electrode 4*a*, while the second auxiliary electrode 3 is connected to the second electrode 4*b* (FIGS. 7*b* to 7D)

(Step 1)

The substrate 1 is appropriately cleaned using a detergent, pure water and an organic solvent, and then, an auxiliary electrode material is deposited on the substrate 1 using the vacuum evaporation method or the sputtering method, etc. Thereafter, the first auxiliary electrode 2 and the second auxiliary electrode 3 are formed using the photolithography technique, etc (FIG. 7A).

The auxiliary electrodes 2 and 3 must be designed, and the distance between them and their lengths and shapes are appropriately determined, in accordance with the application of the electron-emitting device. For example, when an electron-emitting device is to be employed in a display device for a television set, which will be described later, the resolution to be used must be taken into account when the auxiliary electrodes 2 and 3 are designed, and since the pixel size for a high definition (HD) television is small, a high resolution is required. Therefore, in order to obtain sufficient brightness with an electron-emitting device having a limited size, the auxiliary electrodes 2 and 3 must be so designed that a satisfactory emission current Ie can be obtained.

In this example, the practical distance between the auxiliary electrodes 2 and 3 is equal to or longer than 5 μm and equal to or shorter than 100 μm, and the practical thickness of the auxiliary electrodes 2 and 3 is equal to or greater than 10 nm and equal to or smaller than 10 μm.

(Step 2)

A conductive film 4 is formed to connect the first and the second auxiliary electrodes 2 and 3 (FIG. 7B). As an available method for forming the conductive film 4, an organic metal solution, for example, is coated on the substrate 1 and dried to form an organic metal film, and thereafter the organic metal film is baked and is patterned using a lift off method and an etching method, etc.

The material for the conductive film 4 can be, for example, a metal such as Ni, Cr, Au, Mo, W, Pt, Ti, Al, Cu or Pd, or an alloy or metal oxide of them, a transparent conductor such as $In_2O_3$—$SnO_2$, or a semiconductor such as a polysilicon semiconductor.

The organic metal solution can be a solution of an organic metal compound that contains, as the main element, a metal such as Pd, Ni, Au or Pt that is used as the conductive film 4. The conductive film 4 in this case is deposited by applying a coating of the organic metal solution; however, the means used to deposit the conductive film 4 is not limited to this method, and the vacuum evaporation method, the sputtering method, the CVD method, the dispersing coating method, the dipping method, the spinner method or the ink jet method, etc, also can be employed.

When a "forming process" is to be performed at the succeeding step, it is preferable that the Rs (sheet resistance) of the conductive film 4 be set within the range $10^2$ Ω/□ to $10^7$ Ω/□. It should be noted that Rs is a value obtained when a resistance R is measured as R=Rs(l/w) in the longitudinal direction of the film, wherein t is the thickness, w is the width and l is the length of the film. When the resistivity is defined as p, Rs=p/t is established. The thickness of the conductive film 4 representing the above described sheet resistance, suitable for practical use, is 5 nm to 50 nm.

(Step 3)

Sequentially, the so-called "forming" process is performed by applying a voltage between the auxiliary electrodes 2 and 3. The second gap 7 is formed in part of the conductive film 4 by the application of the voltage. As a result, the first electrode 4*a* and the second electrode 4*b* are formed opposite each other, transversely across the surface of the substrate 1 (FIG. 7C).

The electrical process that follows the forming process can be performed, for example, by placing the substrate 1 in the measurement/evaluation apparatus shown in FIG. 6 (for convenience, electrodes 2 and 3 are not shown in FIG. 6). The measurement/evaluation apparatus shown in FIG. 6 is a vacuum apparatus wherein required devices, such as a vacuum pump and a vacuum gauge (neither of them shown), are provided to perform various measurements and evaluations in a desired vacuum. The vacuum pump may be constituted by an appendage vacuum pump system, such as a magnetic floatation turbo pump or a dry pump, that does not use oil, and an ultra-high vacuum pump system, such as an ion pump. Furthermore, when a gas introduction device (not shown) is provided for the measurement/evaluation apparatus of this invention, a vapor of a desired organic material can be introduced into the vacuum apparatus under a desired pressure. In addition, the overall heating of the vacuum apparatus and the substrate 1 placed in the vacuum apparatus can be performed by a heater (not shown).

The "forming process" can be performed either by repetitively applying a pulse voltage having a constant pulse height, or by applying a pulse voltage while gradually increasing the pulse height.

Figure 8A:
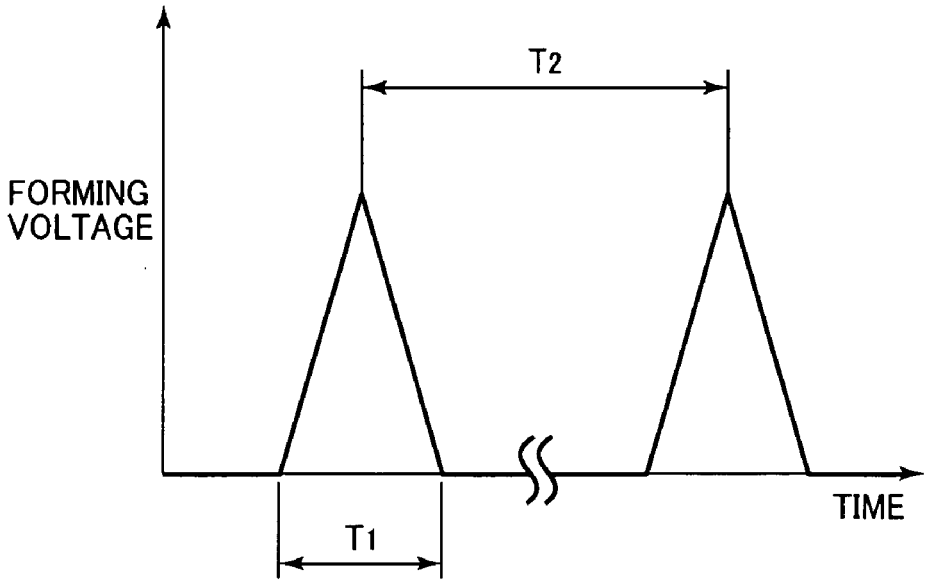
FIGS. 8A and 8B are graphs showing example forming pulses during the manufacture of the electron-emitting device of the invention.

An example pulse wave having a constant pulse height is shown in FIG. 8A. In FIG. 8A, T1 and T2 represent the pulse width and the pulse interval (halt time) of a voltage wave; e.g., T1 can be 1 μsec to 10 msec, and T2 can be 10 μsec to 100 msec. A triangular wave or a rectangular wave can be employed as the pulse wave to be applied.

Figure 8B:
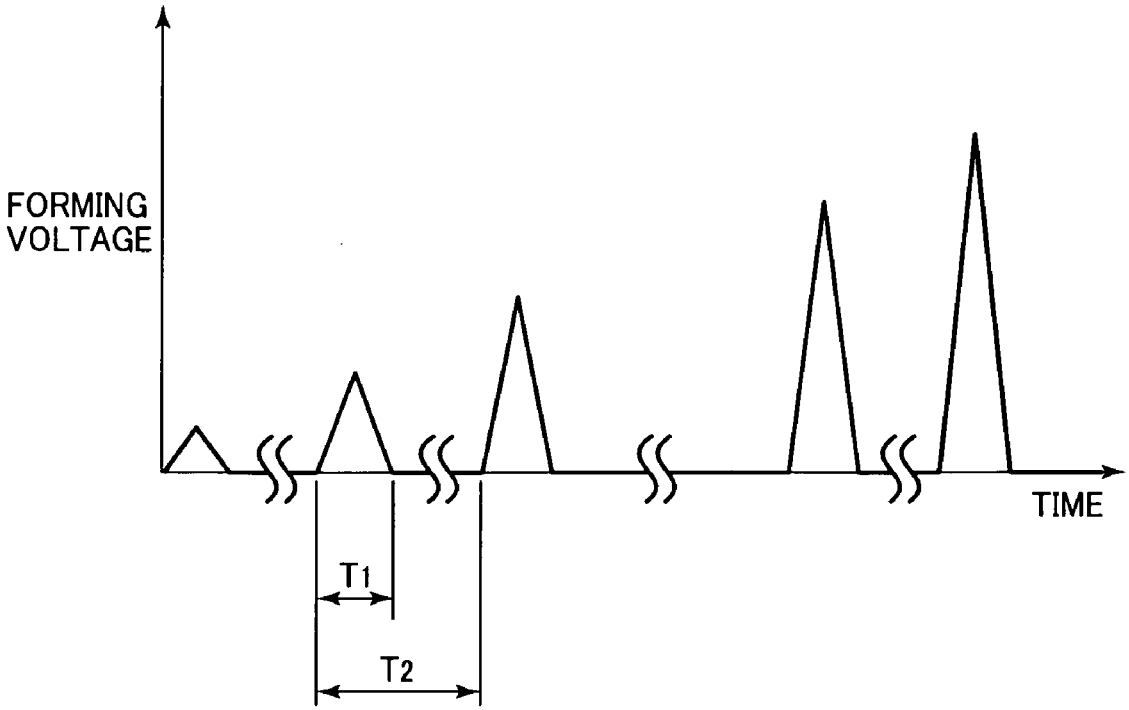

In FIG. 8B is shown an example pulse wave used when a pulse voltage is to be applied while the pulse height is gradually increased. In FIG. 8B, T1 and T2 represent the pulse width and the pulse period of a voltage wave, and T1 can be 1 μsec to 10 msec, while T2 is 10 μsec to 100 msec. A triangular wave or a rectangular wave can be selectively employed as a pulse wave, and the pulse height of the pulse voltage to be applied is increased by, 0.1 V, for example.

Whether the "forming" process should be terminated can be determined in the following manner. During the halt period (interval) for the pulse voltage, the current (device current If) flowing across the auxiliary electrodes 2 and 3 is measured by applying a voltage (e.g., the pulse voltage of about 0.1 V) that does not adversely affect the conductive film 4, and the resistance value of the conductive film 4 described above is obtained. When the resistance is equal to or higher than, for example, 1000 times the resistance before the "forming" process, the "forming" process can be terminated.

The pulse height, the pulse width, the pulse interval (halt time) and the pulse period are not limited to the above described values, and appropriate values can be selected in accordance with the resistance of the electron-emitting device, so as to obtain an appropriate gap 7.

In this example, the electrodes 4*a* and 4*b* are obtained by performing the "forming process" on the conductive film. However, in this invention, a well-known method, such as the photolithography method, can also be employed to form the first and the second electrodes 4*a* and 4*b*. Further, when the first carbon film 21*a* and the second carbon film 21*b* are to be formed through the "activation step", which will be described later, preferably the "forming process" is employed because it is preferable that the gap 7 between the first and the second electrodes 4*a* and 4*b* be narrow. Instead of the "forming process", the FIB (focused ion beam) irradiation method or the electron beam lithography method can also be employed to form the narrow gap 7 in the conductive film 4. Further, so long as various methods described above are employed to obtain a gap between the first auxiliary electrode 2 and the second auxiliary electrode 3, the first electrode 4*a* and the second electrode 4*b* are not always required. However, in order to manufacture the electron-emitting device of the invention at a low cost, it is preferable that the auxiliary electrodes 2 and 3 be employed as electrodes for stably supplying a potential to the carbon films that are formed during the "activation" process, which will be described later, and that the first electrodes 4*a* and the second electrodes 4*b* be employed as electrodes for stably and quickly depositing carbon films (21*a*, 21*b*) in the initial stage of the "activation process".

(Step 4)

The "activation" process is now performed. During the "activation" process, a carbon containing gas is introduced into the vacuum apparatus shown in FIG. 6, and a bipolar pulse voltage is applied to the auxiliary electrodes 2 and 3 (not shown in FIG. 6) under an atmosphere including the carbon containing gas. Through this process, from the carbon containing gas present in the atmosphere, films (carbon films) containing carbon can be deposited, as the first and the second conductive films 21*a* and 21*b*, on the surface of the substrate 1 between the first electrode 4*a* and the second electrode 4*b*, and on the first and the second electrodes 4*a* and 4*b* near the gap 7. As a result, the amount of the emission current Ie can be increased.

An organic material gas may be used as the carbon containing gas, such as alkane, alkene or alkyne aliphatic hydrocarbon, aromatic hydrocarbon, alcohol, aldehyde, ketone, amine, or an organic acid such as phenol, carboxylic acid or sulfonic acid. Specifically, the following organic materials can be employed: saturated hydrocarbon, such as methane, ethane or propane, expressed as Cn H2n+2; unsaturated hydrocarbon, such as ethylene or propylene, expressed, for example, as a composition formula of Cn H2n; benzene; toluene; methanal; ethanal; formaldehyde; acetaldehyde; acetone; methyl ethyl ketone; methylamine; phenol; formic acid; acetic acid; and propionic acid.

It is preferable that the carbon containing gas be introduced into the vacuum apparatus after the pressure therein has been reduced to $10^{-6}$ Pa. Since the preferable partial pressure for the carbon containing gas differs depending on the form of the electron-emitting device, the shape of the vacuum apparatus and the type of carbon containing gas that is employed, the partial pressure is appropriately designated.

Figure 9A:
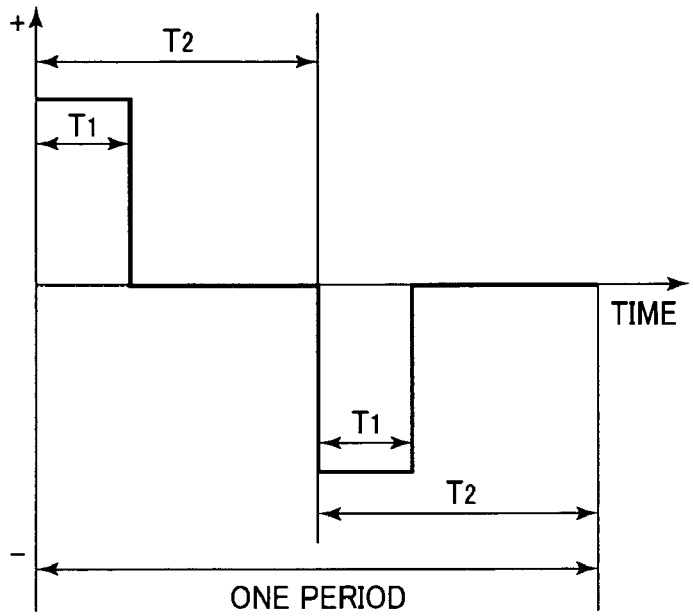
FIGS. 9A and 9B are graphs showing example activation pulses during the manufacture of the electron-emitting device of the invention.
Figure 9B:
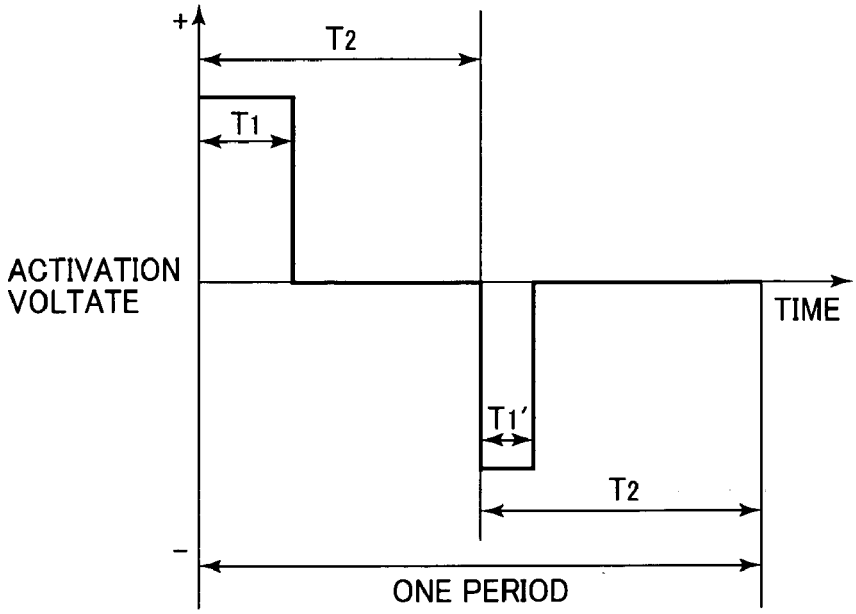

The pulse wave shown in FIG. 9A or 9B can be employed as a voltage wave to be applied to the auxiliary electrodes 2 and 3. during the "activation" process. Preferably, the maximum voltage value to be applied is appropriately selected within the practical range of 10 V to 25 V. In FIG. 9A, T1 represents a pulse width of the pulse voltage to be applied, and T2 represents a pulse period. In this example, the absolute values of the positive and negative voltage values are equal; however, there is a case wherein these values differ. In FIG. 9B, T1 is the pulse width of the pulse voltage having a positive value, and T1' is the pulse width of the pulse voltage having a negative value, while T2 is a pulse period. In this example, T1>T1', and the absolute values of the positive and negative voltage values are equal. However, there is a case wherein the absolute values of the positive and negative voltage values differ.

Figure 10:
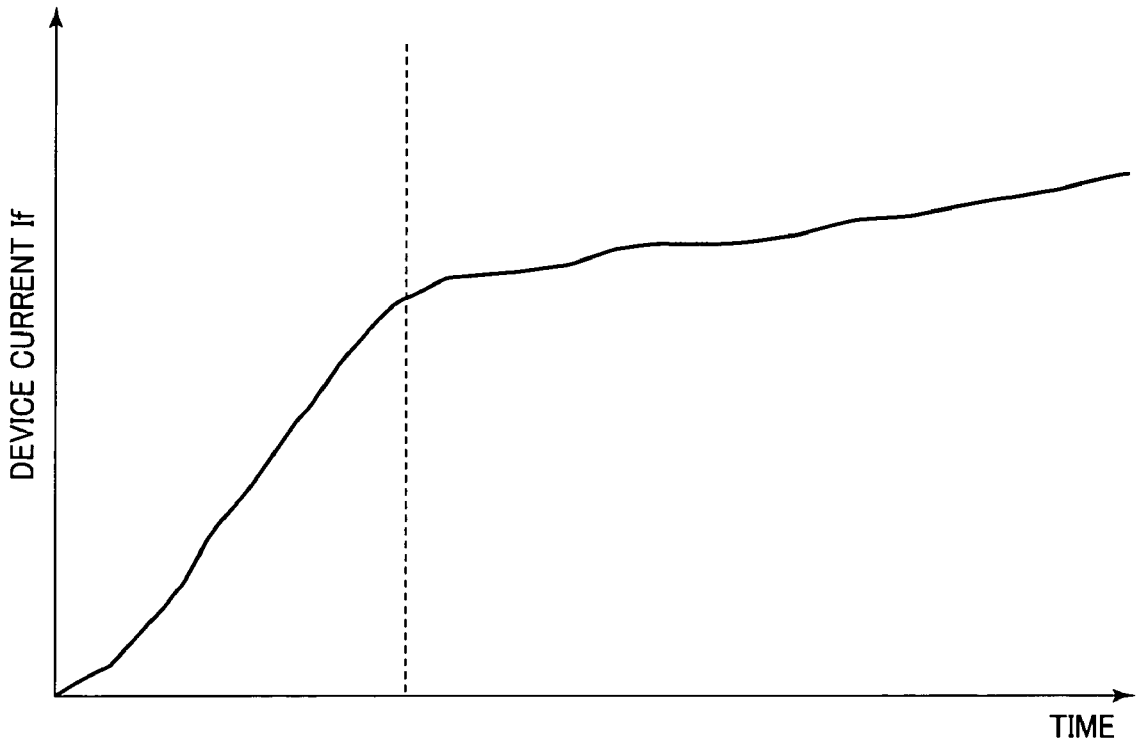
FIG. 10 is a graph showing the movement of an activation current for the electron-emitting device of the invention.

FIG. 10 is a graph showing the profile of the device current If during the "activation" process. It is preferable that the "activation" process be terminated after the rise in the device current If moderates (the area to the right from a broken line in FIG. 10).

When a voltage having a waveform shown in FIG. 9A is applied to the auxiliary electrodes 2 and 3 during the "activation" process, the first carbon film 21*a* and the second carbon film 21*b*, which have substantially the same thickness as schematically shown in FIG. 3B, can be deposited.

Figure 5A:
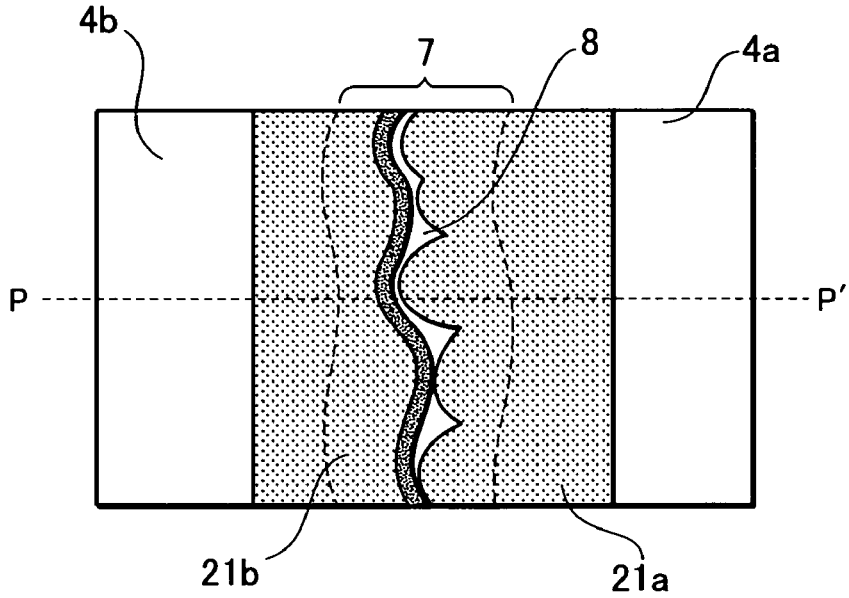
FIGS. 5A and 5B are a schematic plan view and a schematic cross-sectional view of the electron-emitting device for explaining the invention.
Figure 5B:
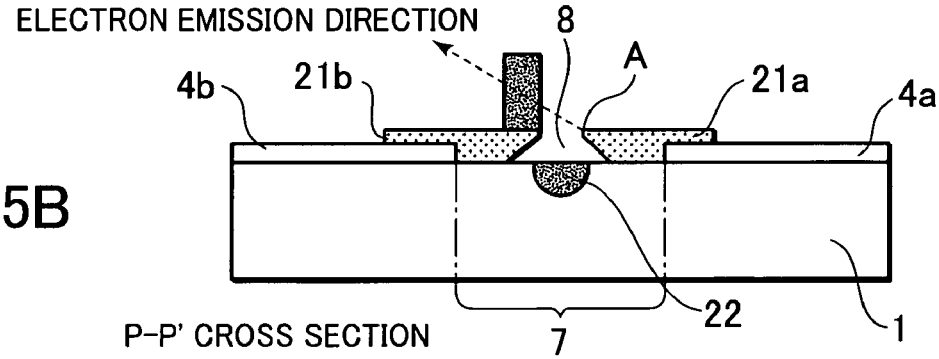

On the other hand, when a voltage having an asymmetrical waveform, as schematically shown in FIG. 9B, is applied to the auxiliary electrodes 2 and 3 during the "activation" process, the first and the second carbon films shown in FIGS. 5A and 5B can be deposited. That is, an asymmetrical structure can be obtained wherein the end of the second carbon film 21*b*, which forms the outer edge at the gap 8, is thicker than the end of the first carbon film 21*a*, which forms the outer edge at the gap 8.

Furthermore, when the "activation" process is performed by employing either waveform shown in FIG. 9A or 9B until the device current If enters the area to the right side of the broken line in FIG. 10, the substrate-deformed portion (recessed portion) 22 can be formed. In addition, when the "activation" process is continued until the device current If enters the area to the right side of the broken line in FIG. 10, as is shown in FIGS. 3B and 3C, the distance between the ends of the first and the second carbon films 21*a* and 21*b*, at the position above the surface of the substrate 1, can be shorter than the distance between these films (21*a*, 21*b*) at the surface of the substrate 1. The substrate-deformed portion (recessed portion) 22 regarded as follows.

When the temperature of the substrate 1 is increased under a condition wherein $SiO_2$ (the material of the substrate) is present near carbon, Si is consumed.

$$SiO_2+C \rightarrow SiO\uparrow+CO\uparrow$$

It is assumed that Si in the substrate is consumed because the above reaction has occurred, and that the surface of the substrate 1 is scraped (recessed portion is formed).

With the substrate-deformed portion (recessed portion) 22, the creeping distance between the first carbon film 21*a* and the second carbon film 21*b* can be increased. Thus, it is possible to suppress the discharge breakdown phenomenon that is assumed to occur due to a strong electric field applied between the first and the second carbon films 21*a* and 21*b* when the electron-emitting device is driven, and it is also possible to suppress the occurrence of an excessive device current If.

Carbon contained in the first carbon film 21*a* and the second carbon film 21*b* according to the invention will now be described. It is preferred that the carbon contained in the first and the second carbon films 21*a* and 21*b* be graphite like carbon. Graphite like carbon in the invention includes a complete graphite crystal structure (so-called HOPG), a somewhat incomplete crystal structure (PG) having a grain size of about 20 nm, a more incomplete crystal structure (GC) having a grain size of about 2 nm, and amorphous carbon (amorphous carbon and/or a mixture of amorphous carbon and the micro crystals of the graphite). That is, the graphite like carbon can be satisfactorily employed even when a layer, such as a grain boundary, between graphite grains is disturbed.

(Step 5)

The process is performed to change the shapes of the first carbon film 21*a* and the second carbon film 21*b* to those in FIG. 1 or 3.

Figure 11A:
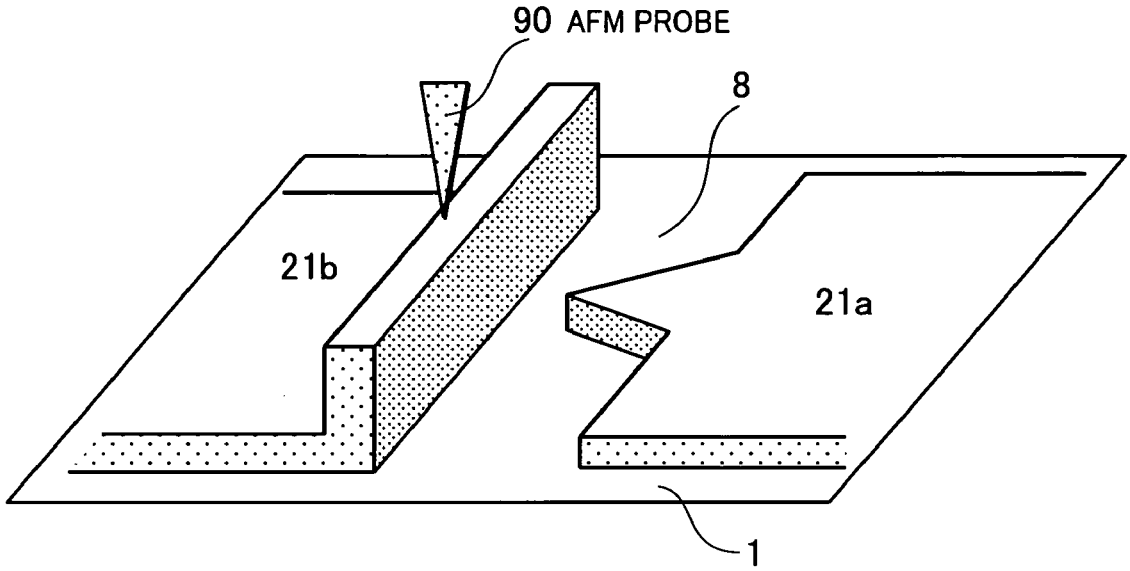
FIGS. 11A and 11B are schematic diagrams showing example processing for scraping a carbon film off the electron-emitting device of the invention.
Figure 11B:
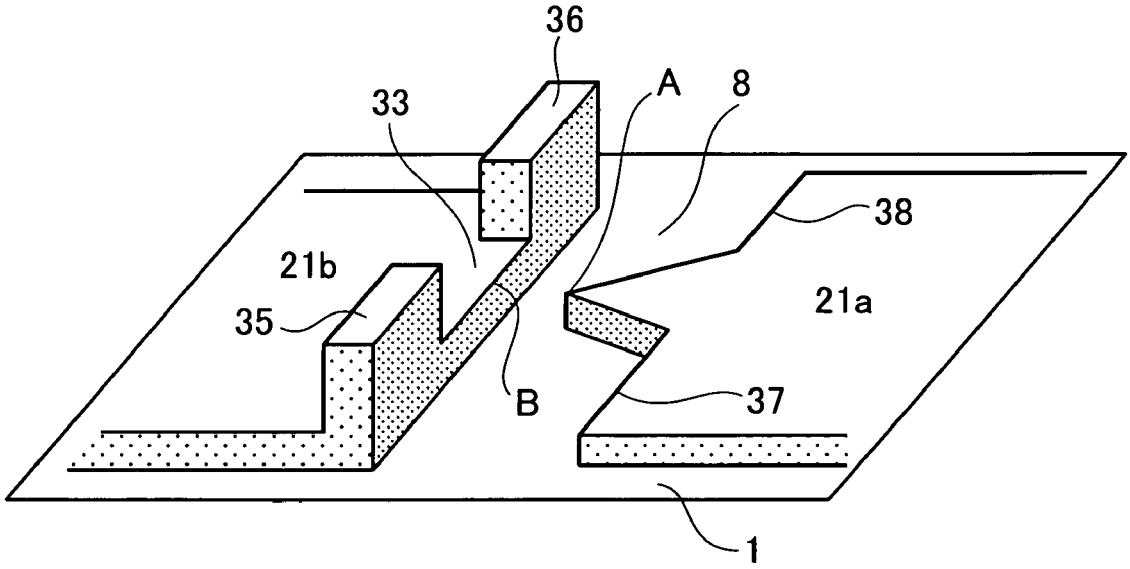

Specifically, a method employing an AFM (Atomic Force Microscope), shown in FIGS. 11A and 11B, may be used to obtain the shapes of the carbon films in FIG. 1 or 3. In this example, the method for using the AFM will be described as the method for changing the shape of the second carbon film 21*b* and/or the first conductive film 21*a*; however, the processing method is not limited to the method that uses the AFM.

The process that uses the AFM is performed as follows. When through the "activation" process the second carbon film 21*b* is formed thicker than the first carbon film 21*a* (a bipolar pulse voltage for which a voltage value or a pulse width is asymmetrical, on the positive side and on the negative side, is repetitively applied), first, the probe 90 of the AFM is positioned on the second carbon film 21*b* (FIG. 11A). Then, the AFM probe 90 is brought into contact with the end of the second carbon film 21*b* (the portion that forms the outer edge at the gap 8) and scrapes it (FIG. 11B).

The end of the second carbon film 21*b* (the second carbon film end) can be scraped in the AFM contact mode (the contact pressure is controlled by a voltage). Using this method, the first portion B, and the second portion 35 and the third portion 36 described while referring to FIG. 1, may be obtained. This process is performed, at intervals, at a plurality of locations at the end of the second carbon film 21*b* (the end of the second carbon film 21*b* that forms the outer edge of the gap 8). Through this processing, as is shown in FIG. 3A, an electron-emitting device having a plurality of the structures shown in FIG. 1 can be manufactured.

Figure 23A:
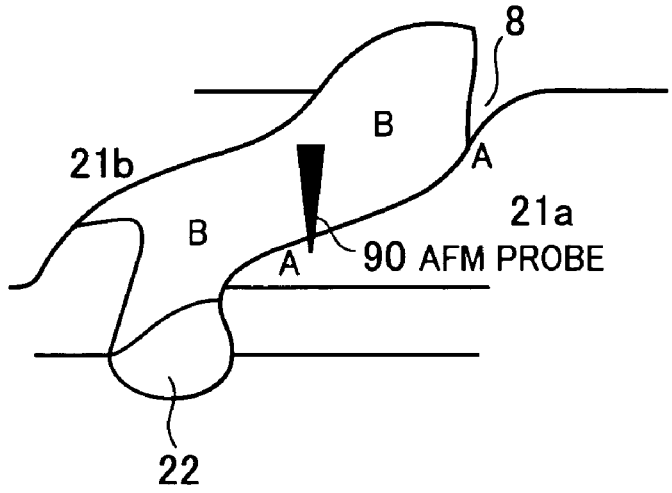
FIGS. 23A to 23C are schematic diagrams showing an example method for manufacturing the electron-emitting device of the invention.
Figure 23B:
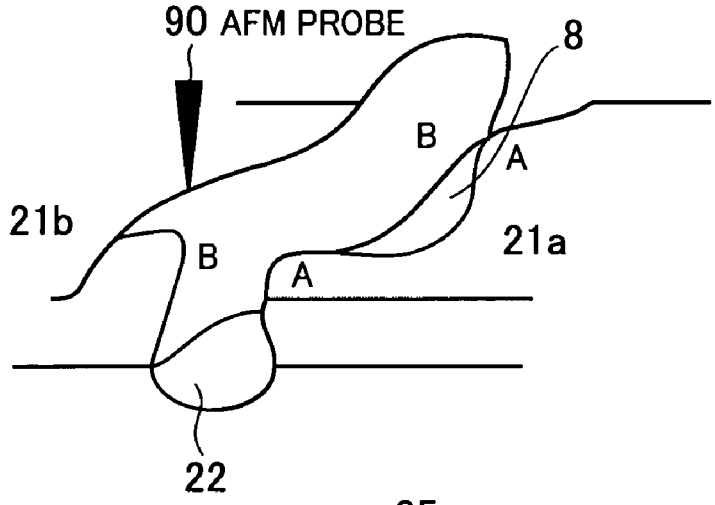
Figure 23C:
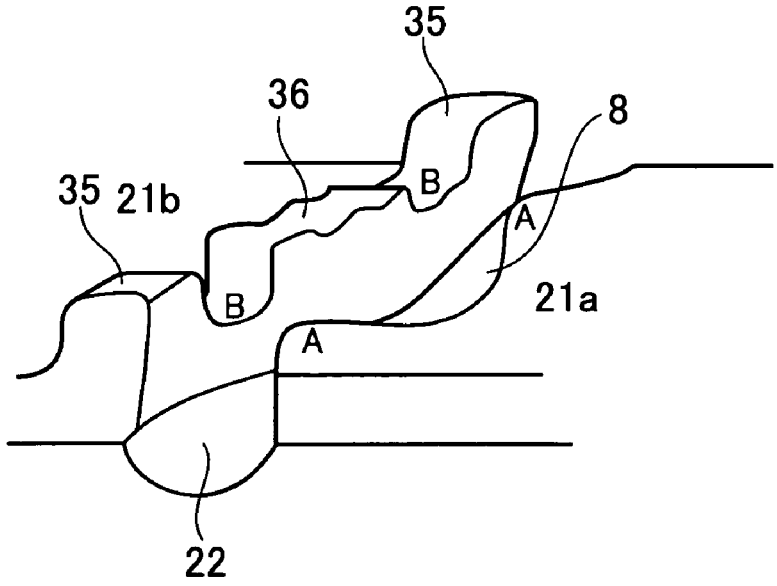

Through the above-described steps, the electron-emitting device of the invention shown in FIG. 1 or 3 can basically be manufactured. Further, the gap 8 between the first carbon film 21*a* and the second carbon film 21*b*, defined during the "activation" process, can be appropriately adjusted. In this case, for example, as is shown in FIG. 23A, the AFM probe 90 is employed to scrape the outer edge of the first carbon film 21*a* (the end of the first carbon film 21*a* that defines the gap 8), so that the desired gap 8 can be defined. Of course, the gap 8 having a desired shape can also be defined by scraping the end of the second carbon film 21*b*. When the shaping of the gap 8 is controlled in this manner, the portions A and B can be formed at desired locations. Thereafter, as well as in FIG. 11A, the AFM probe 90 need only be moved to the end of the second carbon film 21*b* to form the projected portions 35 and 36 (FIGS. 23B and 23C). Further, according to the method for manufacturing the electron-emitting device of the invention, an electron-emitting device having the structure shown in FIG. 1, 2, 22(C) or 23(C) may also be manufactured, without performing the processing for which the AFM is used. As an example method, after the "activation" process has been performed, a desired portion of the carbon film is irradiated by an electron beam, under an atmosphere that includes a carbon containing gas, to form the projected portions 35 and 36. Or, as another available method, during the "activation" process, (I) the type of carbon containing gas, (II) the partial pressure of the carbon containing gas, (III) a voltage waveform to be applied, (IV) the relationship between the time for discharging the carbon containing gas and the time for halting the voltage application and (V) the temperature for the "activation" time are appropriately controlled. Then, the electron-emitting device having the structure explained while referring to FIG. 22(C) or 23(C) may be manufactured without the processing of the above decrived step 5. For these reasons, the present invention does not exclude the electron-emitting device having the structure, explained while referring to FIG. 22(C) or 23 (C), that is manufactured through the "activation" process of the above-decrived step 4 without performing the above-described process of step 5. It should be noted that, after the above-described step 5 (or after the above-described step 4 is performed, when the structure explained while referring to FIG. 22(C) or 23(C) is formed merely by performing the "activation" process of the above-described step 4), preferably, a "stabilization" process is performed to heat the resultant structure in the vacuum. It is preferable that extra carbon and organic substances, which become attached to the surface of the substrate 1, and other portions, during the "activation" process, be removed during the stabilization process.

Specifically, extra carbon and organic substances are discharged into a vacuum container. It is preferable that organic substances in the vacuum container be removed, to the extent possible, until the partial pressure of organic substances is equal to or lower than $1.3\times10^{-8}$ Pa. Furthermore, the pressure throughout the vacuum container, including other gases, is preferably equal to or lower than $1.3\times10^{-6}$ Pa, and more preferably equal to or lower than $1.3\times10^{-7}$ Pa. A vacuum pump apparatus for exhausting the vacuum container can be specifically an adsorption pump or an ion pump that does not use oil, so that there is no chance for oil to adversely affect the electron emission characteristic of the electron-emitting device. Furthermore, it is preferable that the entire vacuum container be heated, so that organic molecules attached to the inner walls of the vacuum container and the electron-emitting device can be easily discharged. The heating should be performed as long as possible at a temperature of 150° C. to 350° C., but preferably equal to or higher than 200° C. However, the heating conditions are not limited to these.

It is preferable that after the "stabilization" process has been terminated, the same atmosphere be maintained when the electron-emitting device is to be driven. However, so long as the organic substances are appropriately removed, the satisfactorily stable characteristic of the electron-emitting device can be maintained even when the pressure is slightly increased.

When the electron-emitting device is driven in such a vacuum atmosphere, the deposition of new carbon or a new carbon compound can be prevented. As a result, the shape of the electron-emitting device of the invention can be maintained, and the device current If and the emission current Ie accordingly stabilized.

The basic characteristic of the electron-emitting device of the invention will now be described while referring to FIGS. 6 and 12.

Figure 12:
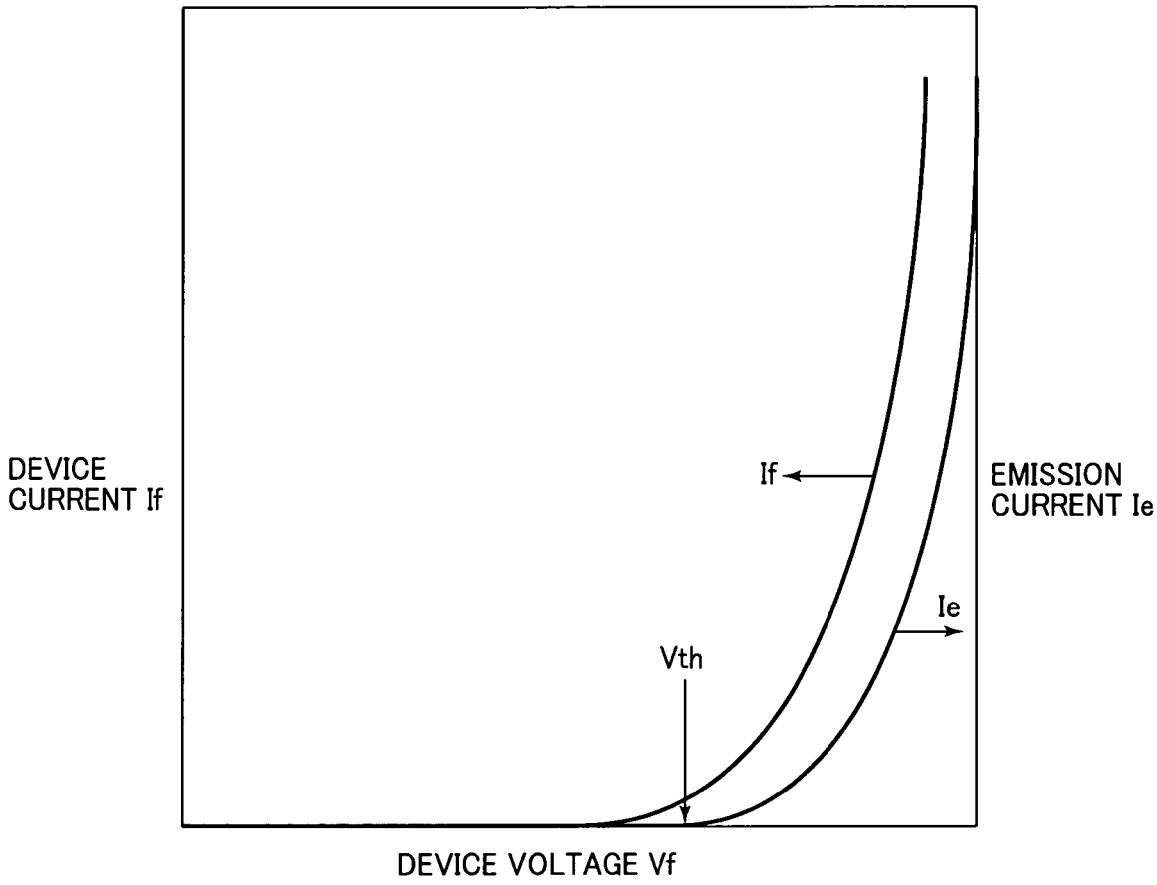
FIG. 12 is a graph showing the electron emission characteristics of the electron-emitting device.

FIG. 12 is a graph showing a typical example relationship between the device voltage Vf, and the emission current Ie and the device current If of the electron-emitting device, which are measured by the measurement/evaluation apparatus shown in FIG. 6 after the "stabilization" process has been performed.

In FIG. 12, since the emission current Ie is considerably smaller than the device current If, it is indicated by using an arbitrary unit. As is apparent from the graph in FIG. 12, relative to the emission current Ie, the electron-emitting device of this invention has three properties.

First, when a device voltage at a specific level or higher (called a threshold voltage; Vth in FIG. 12) is applied, the emission current Ie is sharply increased. But when the threshold voltage Vth or lower is applied, almost no emission current Ie is detected. That is, the electron-emitting device of the invention is a non-linear device for which, relative to the emission current Ie, a clear threshold voltage Vth is present.

Second, since the emission current Ie depends on the device voltage Vf, the emission current Ie can be controlled by using the device voltage Vf.

Third, the emission charges captured by the anode electrode 44 (FIG. 6) depend on the time at which the device voltage Vf is applied. That is, the capture of electric charges by the anode electrode 44 can be controlled in accordance with the time at which the device voltage Vf is applied.

By using the above-described properties of the electron-emitting device, the electron emission characteristic can be easily controlled in consonance with an input signal. Further, since the electron-emitting device of the invention has a stable and high-luminance electron emission characteristic, the electron-emission device can be usable in various fields.

An example of another aspect of the invention will now be explained.

An electron source or an image display device, such as a television set, can be constituted, for example, by arranging a plurality of the electron-emitting devices of the invention on a substrate.

Figure 13:
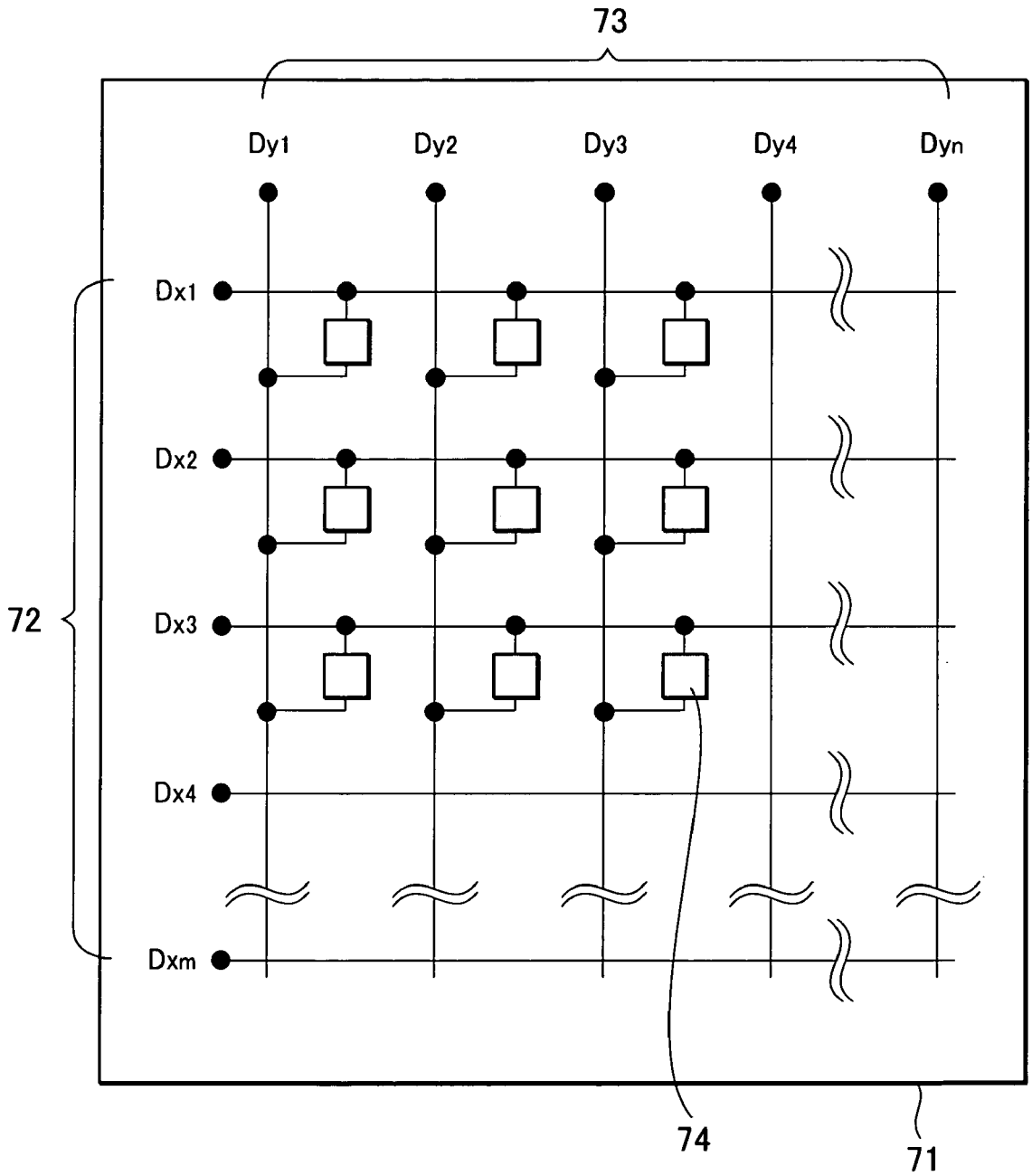
FIG. 13 is a schematic diagram for explaining an electron source substrate according to one embodiment of the invention.
Figure 14:
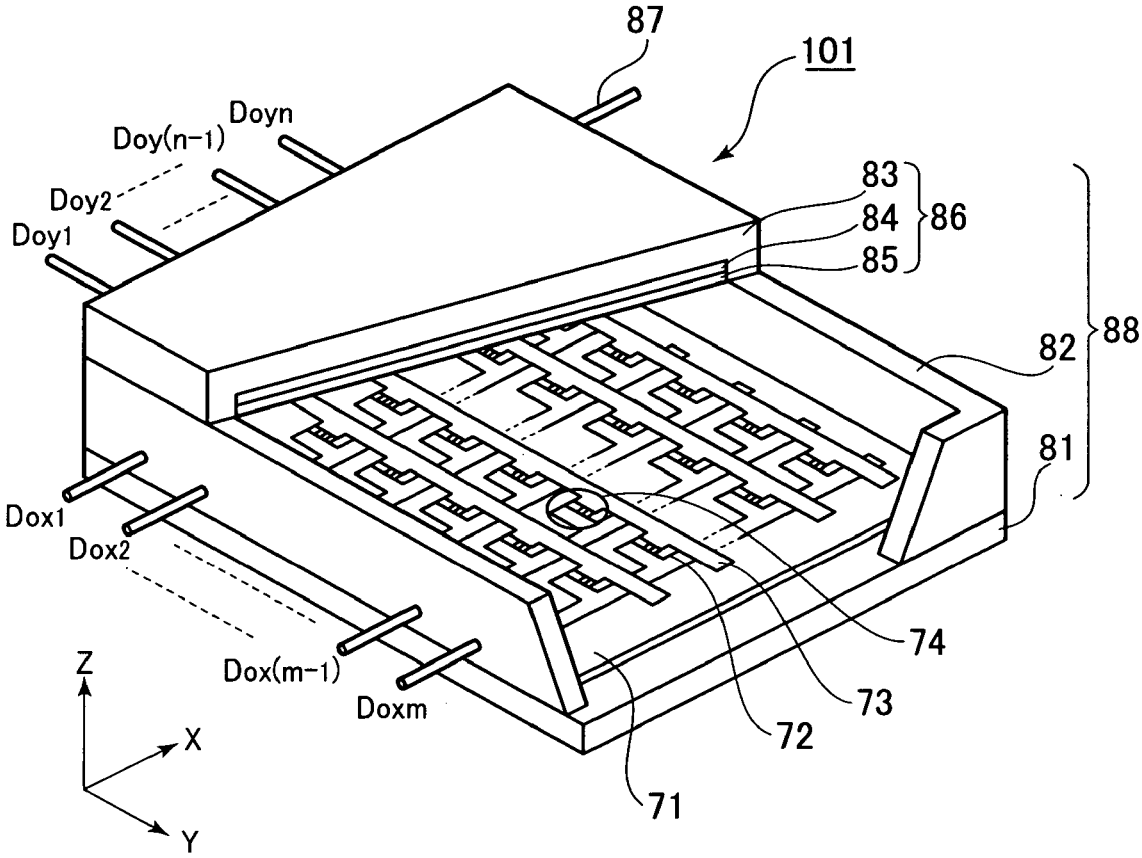
FIG. 14 is a schematic diagram for explaining an example configuration for an image display device according to the embodiment.

The array of the electron-emitting devices arranged on the substrate can, for example, be a "ladder-like" array or a "matrix" array as shown in FIG. 13. For the "ladder-like" array, multiple electron-emitting devices are connected in parallel, and control electrodes (grids) are located above the individual electron-emitting devices in a direction (the direction of columns) perpendicular to the direction in which the electron-emitting devices are arranged (the direction of rows). In this manner, electron emission by the electron-emitting devices can be controlled. For the "matrix array", m X-directional wirings and n Y-directional wirings are prepared, and the first conductive film 21*a* of each electron-emitting device is electrically connected to one of the m X-directional wirings, while the second conductive film 21*b* is electrically connected to one of the n Y-directional wirings (m and n are positive integers) as shown in FIGS. 13 and 14.

This matrix array will now be described in detail.

According to the above described three basic properties of the electron-emitting device of the invention, the electrons to be emitted can be controlled in accordance with the height and width of the pulse voltage that is applied between the first conductive film 21*a* and the second conductive film 21*b*. When the voltage to be applied is lower than the threshold value (Vth), electrons are not substantially emitted. According to these properties, when multiple electron-emitting devices are arranged, and when the pulse voltage is appropriately applied to the individual electron-emitting devices, the number of electrons to be emitted by a selected electron-emitting device can be controlled in consonance with an input signal.

While referring to FIG. 13, an explanation will now be given for the structure of an electron source substrate having a matrix array for which the assembly is based on this principle.

On an insulating substrate 71, m X-directional wirings 72, Dx1 to Dxm, are formed using the vacuum evaporation method, the printing method or the sputtering method, etc. The X-directional wirings 72 are made of metal, and the material, the thickness and the line width therefor are properly designated so that they supply an almost uniform voltage to multiple electron-emitting devices 74. Y-directional wirings 73 Dy1 to Dyn are formed of the same material using the same method as that used for the X-directional witings 72. Between the m X-directional wirings 72 and the n Y-directional witings 73, an insulating layer (not shown) of $SiO_2$, for example, is formed using the vacuum evaporation method, the printing method or the sputtering method.

The individual electron-emitting devices 74 are connected to one of the X-directional wirings 72 and to one of the Y-directional wirings 73.

Further, scan signal application means (not shown), for transmitting a scan signal, is electrically connected to the X-directional wirings 72. Whereas, demodulation signal generation means (not shown) is electrically connected to the Y-directional wirings 73 so as to apply, in synchronization with the scan signal, a modulation signal for modulating electrons emitted by a selected electron-emitting device. These means will be described later in detail. The drive voltage Vf applied to the individual electron-emitting device 74 is supplied as a voltage difference between the scan signal to be applied and the modulation signal.

Figure 15A:
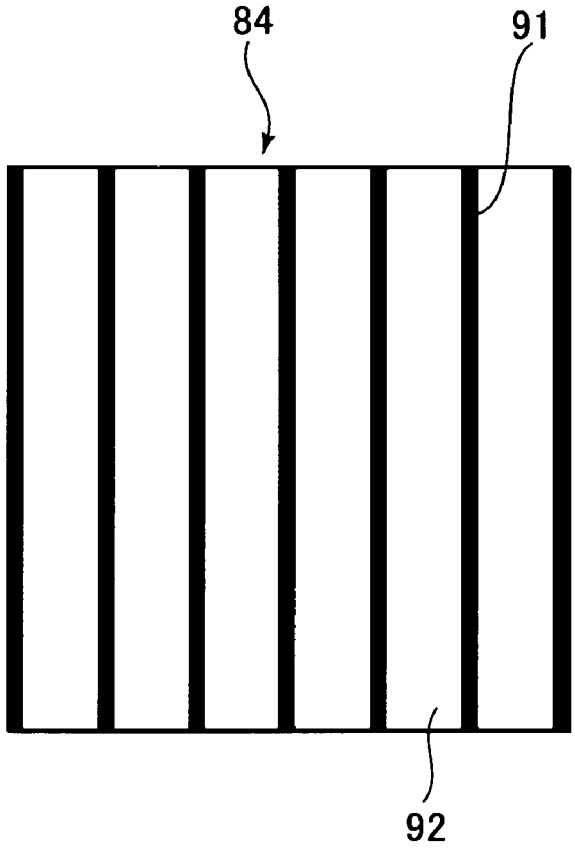
FIGS. 15A and 15B are schematic diagrams for explaining fluorescent films according to the embodiment.
Figure 15B:
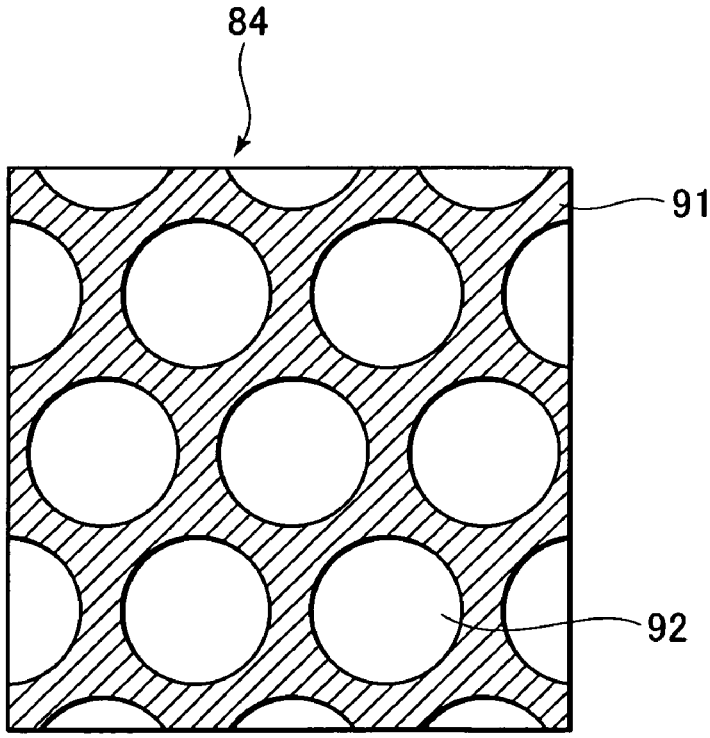

While referring to FIGS. 14, 15A and 15B, an explanation will now be given for an example electron source having the matrix array and for an image display device. FIG. 14 is a diagram showing the basic structure of an envelope 88 for an image display device, and FIGS. 15A and 15B are diagrams showing fluorescent films.

In FIG. 14, a plurality of the electron-emitting devices 74 are provided on the electron source substrate 71, which is fixed to a rear plate 81. In a face plate 86, the fluorescent film 84 and a conductive film 85 are deposited on the inner surface of a transparent substrate 83 made, for example, of glass. The rear plate 81, a support frame 82 and the face plate 86 are sealed by applying a sealing member such as a frit glass at the joints and heating the structure at 400° C. to 500° C. in the air or in a nitrogen atmosphere. The sealed structure can be used as the envelope 88. The conductive film 85 is a member corresponding to the anode electrode 44 explained while referring to FIG. 6.

When the envelope 88 has been sealed in the air or in the nitrogen atmosphere, thereafter, the air in the envelope 88 is evacuated through an exhaust pipe (not shown) until the internal pressure reaches a desired vacuum level (e.g., about $1.3\times10^{-5}$ Pa) and the exhaust pipe is closed. As a result, the envelope 88, which maintains an internal vacuum, can be obtained. Further, when the envelope 88 is sealed in a vacuum, the sealing of the envelope can be performed at the same time, without the exhaust pipe being required, and the envelope 88, which maintains an internal vacuum, can be easily fabricated.

In addition, before or after the envelope 88 is sealed, a getter (not shown) located inside the envelope 88 may be activated. As is described above, before or after the envelope 88 is to be sealed in a vacuum, the getter (not shown) located inside the envelope 88 is activated. As a result, the internal vacuum level of the envelope 88 can be maintained after being closed.

The envelope 88 can be constituted by the face plate 86, the support frame 82 and the rear plate 81. However, since the rear plate 81 is provided mainly for reinforcing the strength of the substrate 71, the rear plate 81 is not required so long as the substrate 71 has sufficient strength. In this case, the support frame 82 is directly sealed to the substrate 71, and the envelope 88 is constituted by the face plate 86, the support frame 82 and the substrate 71.

Further, a support member (not shown) called a spacer may be arranged between the face plate 86 and the rear plate 81 (substrate 71), so that an envelope 88 having an appropriate strength, relative to the air pressure, can be provided.

FIGS. 15A and 15B are diagrams showing specific structures for the fluorescent films 84 shown in FIG. 14. For monochrome, the fluorescent film 84 can be formed of merely a single-color fluorescent layer (phosphor) 92. For a color image display device, the fluorescent film 84 includes fluorescent layers (phosphors) 92 for three primary colors and a light absorption member 91 located among the fluorescent layers 92. The light absorption member 91 is preferably black. In FIG. 15A, the light absorption members 91 are arranged in a striped shape, whereas in FIG. 15B, they are arranged in a matrix shape. Generally, the arrangement in FIG. 15A is called a "black stripe", and the arrangement in FIG. 15B is called a "black matrix". For a color display, the light absorption members 91 are provided, so that a mixture of colors, between the fluorescent layers 92 for the different phosphor colors (typically the three primary colors), will be less noticeable, and so that a reduction in the contrast due to the reflection of external light by the fluorescent film 84 can be suppressed. The material used for the light absorption member 91 is not limited to a common material that contains graphite as a main element, but can be some other material that has low light transmitivity and low light reflectivity. Furthermore, a conductive or insulating material can be employed.

The conductive film 85 (FIG. 14), called a "metal-back" film, is deposited on the inner wall of the fluorescent film 84 (near the rear plate 81). The purposes of the conductive film 85 are: of the light emitted by the phosphors 92, light directed toward the electron-emitting device is reflected to the face plate 86 to increase the luminance; an electrode to which an electron beam acceleration voltage is to be applied is provided; and damage to the phosphors 92 due to the collision of negative ions generated in the envelope 88 is reduced.

The conductive film 85 is preferably an aluminum film. After the fluorescent film 84 has been deposited, a smoothing process (generally called "filming") is performed for the surface of the fluorescent film 84, and thereafter, Al is deposited by vacuum evaporation to obtain the conductive film 85.

A transparent electrode (not shown) made, for example, of ITO may be formed between the fluorescent film 84 and the plate 83 to increase the conductivity of the fluorescent film 84.

A voltage is applied to the individual electron-emitting devices in the envelope 88 via terminals Dox1 to Doxm and Doy1 to Doyn, which are connected to the X-directional wirings 72 and the Y-directional wirings 73. With this arrangement, electrons can be emitted by a desired electron-emitting device. At this time, a voltage equal to or higher than 5 kV and equal to or lower than 30 kV, but preferably equal to or higher than 10 kV and equal to or lower than 20 kV, is applied to the metal back 85 via a high voltage terminal 87. The distance between the face plate 86 and the substrate 71 is preferably set equal to or longer than 1 mm and equal to or shorter than 3 mm. With this structure, electrons emitted by a selected electron-emitting device are transmitted through the metal back, and collide with the fluorescent film 84. Then, since the phosphor(s) 92 become luminous, an image can be displayed.

For this arrangement, the details, such as the materials of the members, are not limited to those described above, and can be appropriately changed in accordance with predetermined design/operating criteria the intended purposes.

Furthermore, an information display/reproduction apparatus can be provided by employing the envelope (image display device) 88 of this invention, which was explained while referring to FIG. 14.

Specifically, an information display/reproduction apparatus comprises: a receiver, for receiving a broadcast signal, such as a television broadcast signal, etc; and a tuner, for selecting a received signal, whereby, at least video information, character information or audio information included in the selected signal is output to the envelope (image display device) 88 for a display and/or for reproducing images and/or sound. Of course, when a broadcast signal is encoded, the information display/reproduction apparatus of the invention can also include a decoder. An audio signal is output to separately provide audio reproduction means, such as a loudspeaker, so that sounds are released in synchronization with the video information and the character information reproduced in the envelope (image display device) 88.

The following method, for example, can be employed to output video information or character information to the envelope (image display device) 88 and to display and/or reproduce the information.

Figure 24:
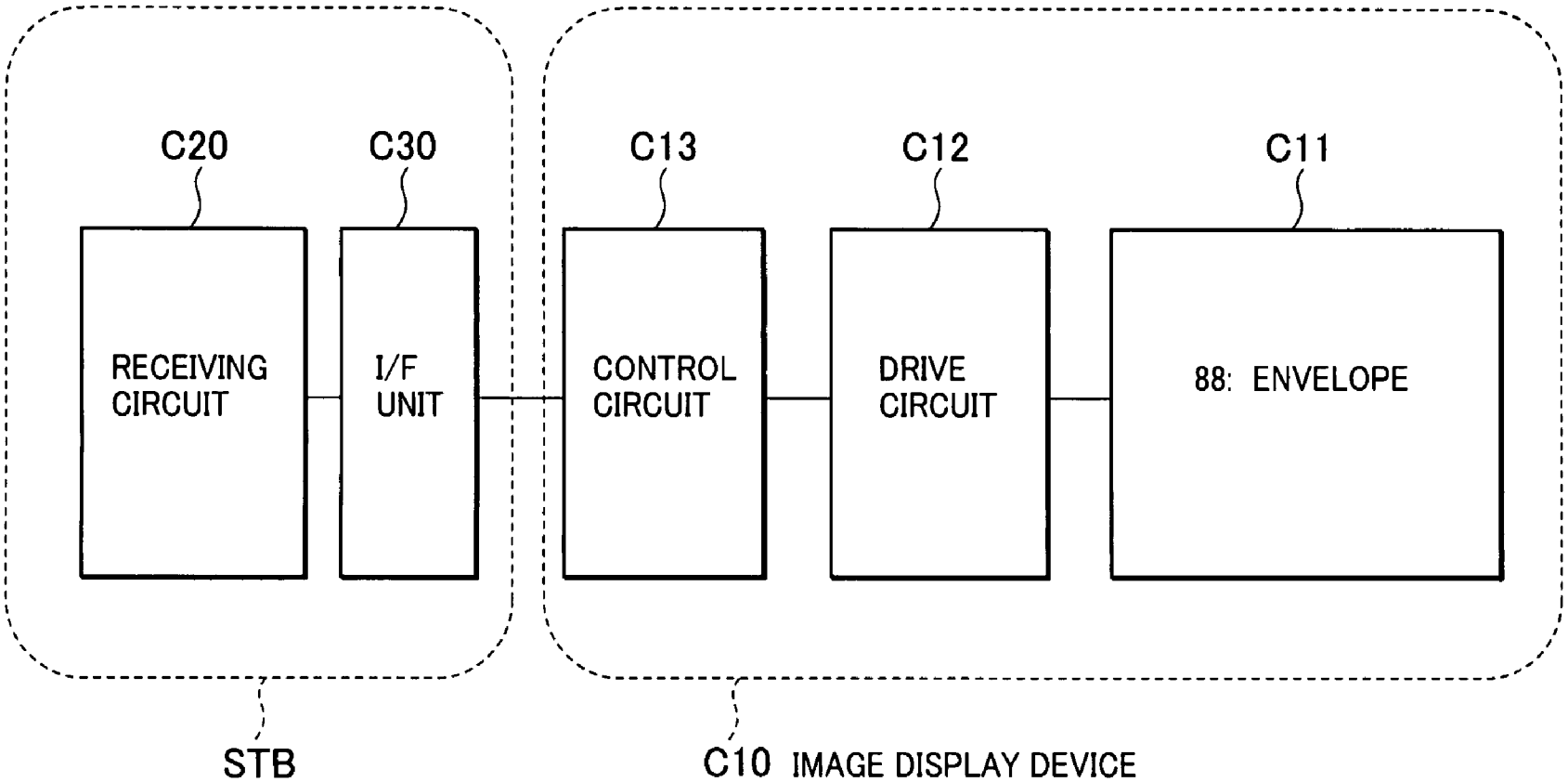
FIG. 24 is a diagram showing an example configuration for an information display/reproduction apparatus employing the image display device according to the invention.

FIG. 24 is a block diagram showing a television according to the present intention. A receiving circuit C20, which includes a tuner and a decoder (not shown), receives television signals, such as satellite broadcast signals and terrestrial broadcast signals, and data broadcast across a network, and outputs decoded video data to an I/F unit (an interface unit) C30. The I/F unit C30 converts the video data into a display format for an image display device C10, and outputs the image data to the display panel C11 of device C10 (88). The image display device C10 includes the display panel C11 (which includes the envelope 88), a drive circuit C12 and a control circuit C13. The control circuit C13 performs, for the received image data, an image process, such as a correction process appropriate for the display panel C11, and outputs the obtained image data and various control signals to the drive circuit C12. The drive circuit C12 employs the received image data to output a drive signal to the individual wirings (see Dox1 to Doxm and Doy1 to Doyn in FIG. 14) of the display panel C11 (88), and a picture is displayed. The receiving circuit C20 and the I/F unit C30 may be stored as a set top box (STB) in a housing separate from the image display device C10, or may be stored in a single housing together with the image display device C10.

The interface unit C30 can be connected to an image recording apparatus or to an image output apparatus (not shown), such as a printer, a digital video camera, a digital camera, a hard disk drive (HDD) or a digital video disk (DVD). With the thus structured information display/reproduction apparatus (or television), an image stored in the image recording apparatus can be displayed on the display panel C11, or an image displayed on the display panel C11 can be processed, as needed, and output to the image output apparatus.

The configuration of the image display device described above is merely an example to which the present invention can be applied, and various modifications are available based on the technical idea of the invention. Further, various information display/reproduction apparatuses can be provided when the image display device of the invention is connected to a system, such as a video conference system or a computer system.

The present invention will now be described in more detail while referring to the embodiments described below.

First Embodiment

The basic configuration of an electron-emitting device manufactured in accordance with this embodiment is the same as that in FIGS. 3A-3C. Further, basically the same method as shown in FIGS. 7A to 7D and 11A and 11B is employed to manufacture the electron-emitting device for this embodiment. While referring to FIGS. 1, 3A to 3C, 7A to 7D, and 11A and 11B, an explanation will now be given of the basic structure of the electron-emitting device for this embodiment and the manufacturing method therefor.

(Step-a) First, the first auxiliary electrode 2 and the second auxiliary electrode 3 are formed on the silica glass 1 that has been cleaned (FIG. 7A).

Specifically, a registration pattern is prepared in advance on the substrate 1 in consonance with the space between the first auxiliary electrode 2 and the second auxiliary electrode 3. Then, Ti, 5 nm thick, and Pt, 45 nm thick, are deposited in order, and the registration pattern is melted by using an organic solvent to lift off the Pt/Ti film. As a result, the first auxiliary electrode 2 and the second auxiliary electrode 3 are formed. The distance between the first and the second auxiliary electrodes 2 and 3 is preferably 20 μm, and the widths of the first and the second auxiliary electrodes 2 and 3 are 500 μm.

(Step-b) A Cr film, 100 nm thick, was deposited on the substrate 1 by vacuum evaporation, and an opening is patterned in consonance with a conductive film that will be described later. Then, an organic palladium compound solution is applied to the substrate 1 by a spinner, and the resultant substrate 1 is annealed at 300° C. for twelve minutes. The thus formed conducive film 4, which contains Pd as the main element, preferably is 6 nm thick, and the sheet resistance Rs preferably is $3\times10^4$ Ω/□.

(Step-c) The Cr film and the conductive film 4 obtained after being annealed are etched using an acid etchant, and the conductive film 4, having a width of preferably 100 μm, is obtained (FIG. 7B).

Through (Step-a) to (Step-c), described above, the first auxiliary electrode 2, the second auxiliary electrode 3 and the conductive film 4 are formed on the substrate 1. (Step-d) Then, the substrate 1 wherein the conductive film 4 was deposited is placed in the measurement/evaluation apparatus shown in FIG. 6, and the air in the measurement/evaluation apparatus is evacuated until a vacuum level of $1\times10^{-6}$ Pa is reached. Then, a voltage is applied to the first and the second electrodes 2 and 3 by the power source 41, and the "forming" process is performed. As a result, the second gap 7 is formed in the conductive film 7, and the first electrode 4*a* and the second electrode 4*b* are formed (FIG. 7C).

A voltage waveform used for this "forming" process is shown in FIG. 8B. In FIG. 8B, T1 and T2 represent a pulse width and a pulse interval, and in this embodiment, T1 is 1 msec, while T2 is 16.7 msec. The pulse used for this embodiment is a triangular pulse, and the "forming" process is performed while the pulse height is increased by 0.1 V. Further, during the "forming" process, a resistance measurement pulse is also inserted to measure resistance. The "forming" process is supposed to be terminated when a resistance of equal to or higher than 1 MΩ is measured using the resistance measurement value, and at this time, the application of the voltage to the first and the second auxiliary electrodes 2 and 3 is terminated.

(Step-e) Sequentially, methanol is introduced to the vacuum apparatus through a slow leak valve, and the pressure level of $1.3\times10^{-4}$ Pa is maintained. In this state, the pulse voltage having a waveform shown in FIG. 9B was applied to the first and the second auxiliary electrodes 2 and 3, and the "activation" process is performed. In the waveform shown in FIG. 9B, T1 is 1 msec, T1' is 0.1 msec and T2 was 10 msec, in the present embodiment.

During the "activation" process, the first auxiliary electrode 2 is constantly secured to the ground potential, and the pulse voltage having the waveform shown in FIG. 9B is applied to the second auxiliary electrode 3.

When sixty minutes have elapsed, it is confirmed that the "activation" process has already entered the area to the right of the broken line in FIG. 10, the application of the voltage is halted, and the slow leak valve is closed. The "activation" process is thereafter terminated. As a result, the first carbon film 21*a* and the second carbon film 21*b* are formed (FIG. 7D).

At this step, three electron-emitting devices are manufactured: an electron-emitting device obtained through the "activation" process under a condition wherein the maximum voltage value in the waveform in FIG. 9B is ±12 V; an electron-emitting device obtained through the "activation" process under a condition wherein the maximum voltage value is ±22 V; and an electron-emitting device obtained through the "activation" process under a condition wherein the maximum voltage value is ±30 V.

The electron-emitting devices manufactured using the same method used for (Step-a) to (Step-e), described above, were prepared, and the plane SEM images and cross-section SEM images of these devices are observed. As is shown in FIGS. 5A and 5B, regardless of the voltage applied during the "activation" process, the ends of the first carbon film 21*a* and the second carbon film 21*b* (the portions that form the outer edge at the gap 8) are asymmetrical, and the thickness at the end of the first carbon film 21*a* (height from the surface of the substrate 1) is 20 nm, while the thickness at the second carbon film 21*b* (height from the surface of the substrate 1) is 100 nm. Further, the thickness of the second carbon film 21*b* is 100 nm in the direction in which the portion A of the first carbon film 21*a* and the portion B of the second carbon film 21*b* opposed each other (i.e., the direction in which electrons are emitted). Furthermore, the cross-section TEM (Transmission Electron Microscope) image of each of the electron-emitting devices is observed, and the distance d between the portion A of the first carbon film 21*a* and the portion B of the second carbon 21*b* is measured. The distance d is 2.2 nm for the electron-emitting device to which the voltage of ±12 V is applied during the "activation" process, 4.3 nm for the electron-emitting device to which the voltage of ±22 V is applied during the "activation" process, and 6.1 nm for the electron-emitting device to which the voltage of ±30 V is applied during the "activation" process.

(Step-f) The electron-emitting devices manufactured at (Step-a) to (Step-e) in this embodiment are extracted to the air from the measurement/evaluation apparatus in FIG. 6, and as described above, a process for changing the shape of a carbon film is performed by using the AFM (Atomic Force Microscope) (see FIGS. 11A and 11B). By scraping the end of the second carbon film 21*b*, the first portion B, the second portion 35 and the third portion 36 are formed (FIG. 11B).

During the "activation" process, for the individual electron-emitting devices obtained by changing the maximum value of the voltage to be applied, the thickness of the first portion B is adjusted to 20 nm using the AFM. It should be noted that a difference h (the height h of the "projected portion" between the first portion B and the second and the third portions 35 and 36) is 80 nm. Further, electron-emitting devices are manufactured for which there are nine distances w between the second and the third portions 35 and 36 (the "projected portions"), 5 nm, 9 nm, 13 nm, 30 nm, 50 nm, 100 nm, 200 nm, 300 nm and 500 nm (see FIG. 1 for the height h of the projected portions and the distance w of the projected portions). Since the end A of the carbon film 21*a* is not scraped and remains unchanged, the thickness of the end A is 20 nm. This process is performed at multiple locations along the gap 8, specifically, for the portions at which the gap 8 is narrower than at the other areas, i.e., where the distance between the first and the second carbon films is shorter.

Electron-emitting devices for comparison example 1 are manufactured using the same method as in (Step-a) to (Step-e), described above. Furthermore, except for changing a voltage waveform at (step-e), electron-emitting devices for comparison example 2 are manufactured using the same method as in (Step-a) to (Step-e). It should be noted that (Step-f) is not performed for the electron-emitting devices for comparison examples 1 and 2.

During the "activation" process for the electron-emitting devices for comparison example 2, the waveform in FIG. 9A is employed, and T1 is 1 msec, while T2 is 10 msec. At this time, the electron-emitting devices for comparison example 2 are obtained, i.e., the electronic-emitting device for which the "activation" process is performed under a condition wherein the maximum voltage value for the waveform in FIG. 9A is ±12 V, the electron-emitting device for which the "activation" process is performed under a condition wherein the maximum voltage value is ±22 V, and the electron-emitting device for which the "activation" process is performed under a condition wherein the maximum voltage value is ±30 V. During the "activation" process, the first auxiliary electrode 2 is constantly secured to the ground potential, while the pulse voltage having the waveform in FIG. 9B is applied to the second auxiliary electrode 3.

Figure 4A:
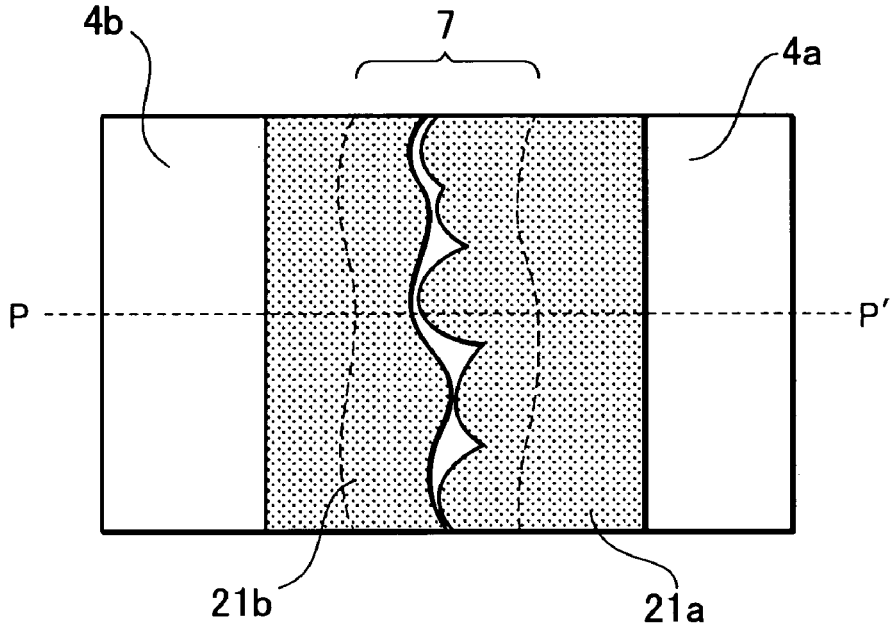
FIGS. 4A and 4B are a schematic plan view and a cross-sectional view of the electron-emitting device for explaining the invention.
Figure 4B:
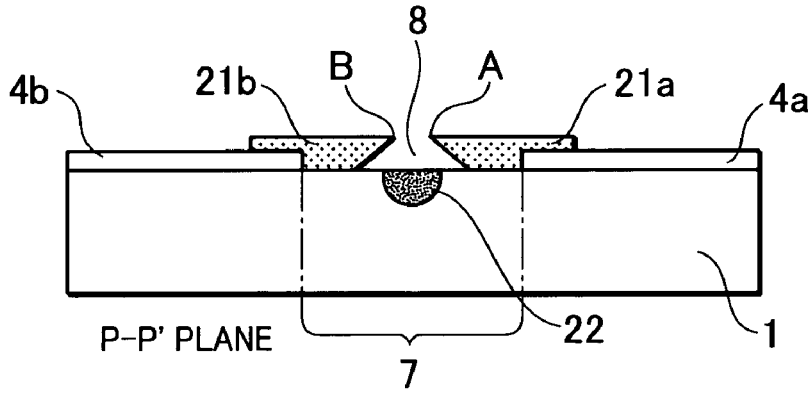

The cross-section SEM images of the thus obtained electron-emitting devices for comparison example 2 are observed. Basically, as is shown in FIGS. 4A and 4B, regardless of the voltage applied during the "activation" process, the end of the first carbon film 21*a* has substantially the same thickness as the end of the second carbon film 21*b*, and the first and the second carbon films 21*a* and 21*b* has a thickness of 40 nm. Further, the cross-section TEM images of the electron-emitting devices for comparison example 2 are observed, and the distance d between the first carbon 21*a* and the second carbon 21*b* is measured. The distance d is 2.2 nm for the electron-emitting device for which the voltage of ±12 is applied during the "activation" process, 4.3 nm for the electron-emitting device for which the voltage of ±22 V is applied during the "activation" process, and 6.1 nm for the electron-emitting device for which the voltage of ±30 V is applied during the "activation" process.

(Step-g) Next, the electron-emitting devices of the invention after (Step-f) is completed and the electron-emitting devices for comparison examples 1 and 2 obtained through (Step-e) without performing (Step-f) are placed in the measurement/evaluation apparatus in FIG. 6. The air in the measurement/evaluation apparatus is discharged, and the "stabilization" process is performed in a vacuum. Specifically, the vacuum apparatus and the electron-emitting devices are heated by a heater, and the discharge of air from the vacuum apparatus is continued while a temperature of about 250° C.

is maintained. After twenty hours elapse, the heating is halted to wait until the temperature of the vacuum apparatus reaches room temperature. Then, the pressure in the vacuum apparatus is about $1\times10^{-8}$ Pa. Sequentially, the electron emission characteristic is measured.

For the measurement of the electron emission characteristic, the distance H between the anode electrode 44 and the electron-emitting device is defined as 2 mm, and a potential of 1 kV is applied to the anode electrode 44 by the high voltage power source 43. In this state, the power source 41 applies a voltage to the auxiliary electrodes 2 and 3, so that the potential of the first auxiliary electrode 2 is higher than the potential of the second auxiliary electrode 3. At this time, a rectangular pulse voltage having a pulse height of 10 V is applied to the electron-emitting device to which the voltage of ±12 V had been applied during the "activation" process, a rectangular pulse voltage having a pulse height of 20 V is applied for the electron-emitting device to which the voltage of ±22 V had been applied during the "activation" process, and a rectangular pulse voltage having a pulse height of 28 V is applied to the electron-emitting device to which the voltage of ±30 V had been applied during the "activation" process.

In the measurement of the electron emission characteristic, the ammeters 40 and 42 are employed to measure the device currents If and the emission currents Ie of the electron-emitting devices of the invention and comparison examples 1 and 2, and the electron emission efficiencies for these devices are calculated.

The obtained electron emission efficiencies are shown in Table 1 below, and the obtained emission currents Ie are shown in Table 2. The device currents If were from 0.8 mA to 1.4 mA for all the applied voltages of 12 V, 22 V and 30 V during the "activation" process.

[Table 1]

As is apparent from these results, when the distance between the second portion 35 and the third portion 36 is equal to or longer than 2d and equal to or shorter than 50d, the emission current Ie of the electron-emitting devices of the invention is larger than that for the electron-emitting devices for comparison example 1, and the electron emission efficiency η is superior.

In addition, after the characteristics are evaluated, the electron-emitting devices of the embodiment are driven for an extended period of time by applying the same pulse voltage as were applied for the characteristic evaluation. As a result, the characteristics shown in Tables 1 and 2 could be maintained for a long time.

After the characteristics are evaluated, the cross-section SEM images of the individual electron-emitting devices of this embodiment are observed. The thickness D ("depth" D) of the second carbon film 21*b* in the direction in which the portion A of the first carbon film 21*a* is opposite the portion B of the second carbon 21*b* (the direction in which the electrons are emitted) is 20 nm (see FIG. 1 for the "depth" D). Further, it was confirmed that, for the individual electron-emitting devices, the distances between the second portion 35 and the third portion 36 were 5 nm, 9 nm, 13 nm, 30 nm, 50 nm, 100 nm, 200 nm, 300 nm and 500 nm.

Moreover, it was also confirmed that the substrate-deformed portion (recessed portion) 22 was also formed in the surface of the substrate 11 between the carbon films 21*a* and 21*b*.

TABLE 1

(Efficiency)

| | Comparison Example 2 | Comparison Example 1 | Embodiment 1 | | | | | | | | |
|---|---|---|---|---|---|---|---|---|---|---|---|
| | Gap 0 nm | Gap 0 nm | 5 nm | 9 nm | 13 nm | 30 nm | 50 nm | 100 nm | 200 nm | 300 nm | 500 nm |
| 12 V (d = 2.2 nm) | 0.05% | 0.08% | 0.10% | 0.16% | 0.21% | 0.17% | 0.12% | 0.09% | 0.05% | 0.05% | 0.05% |
| 22 V (d = 4.3 nm) | 0.10% | 0.18% | 0.18% | 0.28% | 0.37% | 0.40% | 0.35% | 0.29% | 0.25% | 0.18% | 0.18% |
| 30 V (d = 6.1 nm) | 0.30% | 0.49% | 0.49% | 0.49% | 0.58% | 0.77% | 0.96% | 0.86% | 0.72% | 0.52% | 0.31% |

[Table 2]

TABLE 2

| | Comparison Example 2 | Comparison Example 1 | Embodiment 1 | | | | | | | | |
|---|---|---|---|---|---|---|---|---|---|---|---|
| | | Gap 0 nm | 5 nm | 9 nm | 13 nm | 30 nm | 50 nm | 100 nm | 200 nm | 300 nm | 500 nm |
| 12 V (d = 2.2 nm) | 0.68 uA | 1.1 uA | 1.3 uA | 2.2 uA | 2.9 uA | 2.3 uA | 1.6 uA | 1.2 uA | 0.68 uA | 0.67 uA | 0.69 uA |
| 22 V (d = 4.3 nm) | 1.2 uA | 2.1 uA | 2.1 uA | 3.3 uA | 4.5 uA | 4.7 uA | 4.1 uA | 3.3 uA | 2.5 uA | 1.7 uA | 1.2 uA |
| 30 V (d = 6.1 nm) | 2.7 uA | 3.9 uA | 4.0 uA | 4.0 uA | 5.2 uA | 6.8 uA | 8.1 uA | 7.3 uA | 6.1 uA | 4.5 uA | 2.7 uA |

Second Embodiment

In a second embodiment of the present invention, a difference h of the thickness between the first portion B and the second and the third portions 35 and 36 is changed.

In this embodiment, electron-emitting devices are manufactured in the same manner as in the first embodiment, except that in (Step-f) in the first embodiment is changed to the following method. Thus, only (Step-f) will now be explained. Comparison examples 1 and 2 are also the same as those used in the first embodiment.

(Step-f) The electron-emitting devices of this embodiment manufactured at (Step-a) to (Step-e) are extracted to the air from the measurement/evaluation apparatus in FIG. 6, and as is described above, the process for changing the shape of a carbon film is performed by using the AFM (see FIGS. 11A and 11B). By scraping the end of the second carbon film 21*b*, the first portion B, the second portion 35 and the third portion 36 are formed (FIG.

During the "activation" process, for the individual electron-emitting devices manufactured by changing the maximum value of the applied voltage, the thickness of the first portion B is adjusted to 20 nm by using the AFM, and the distance w between the second portion 35 and the third portion 36 is adjusted to 30 nm. Then, nine types of electron-emitting devices are provided wherein the differences h of the thickness between the first portion B and the second and the third portions 35 and 36 are 3 nm, 5 nm, 7 nm, 9 nm, 11 nm, 13 nm, 30 nm, 50 nm and 80 nm. Since the end A of the carbon film 21*a* is not scraped and remained unprocessed, the thickness of the end A is 20 nm. This process is performed at multiple places along the gap 8, specifically, at the portions where the gap 8 is narrower than at the other areas, i.e., where the distance between the first and the second carbon films is shorter.

The electron emission characteristics of the electron-emitting devices manufactured in the second embodiment is measured in the same manner as in the first embodiment. The electron emission efficiencies obtained by calculation are shown in Table 3, and the emission currents Ie obtained by measurement are shown in Table 4.

[Table 3]

TABLE 3

| | Comparison Example 1 | Comparison Example 2 Film Thickness Difference 0 nm | Embodiment 2 3 nm | 5 nm | 7 nm | 9 nm | 11 nm | 13 nm | 30 nm | 50 nm | 80 nm |
|---|---|---|---|---|---|---|---|---|---|---|---|
| 12 V (d = 2.2 nm) | 0.08% | 0.05% | 0.05% | 0.10% | 0.12% | 0.13% | 0.14% | 0.16% | 0.16% | 0.17% | 0.18% |
| 22 V (d = 4.3 nm) | 0.18% | 0.10% | 0.10% | 0.10% | 0.09% | 0.20% | 0.25% | 0.36% | 0.38% | 0.40% | 0.42% |
| 30 V (d = 6.2 nm) | 0.49% | 0.30% | 0.30% | 0.31% | 0.29% | 0.30% | 0.31% | 0.52% | 0.56% | 0.72% | 0.76% |

[Table 4]

TABLE 4

| | Comparison Example 1 | Comparison Example 2 Film Thickness Difference 0 nm | Embodiment 2 3 nm | 5 nm | 7 nm | 9 nm | 11 nm | 13 nm | 30 nm | 50 nm | 80 nm |
|---|---|---|---|---|---|---|---|---|---|---|---|
| 12 V (d = 2.2 nm) | 1.1 uA | 0.68 uA | 0.7 uA | 1.3 uA | 1.5 uA | 1.6 uA | 1.8 uA | 2.0 uA | 2.1 uA | 2.1 uA | 2.3 uA |
| 22 V (d = 4.3 nm) | 2.1 uA | 1.2 uA | 1.1 uA | 1.2 uA | 1.2 uA | 2.5 uA | 2.9 uA | 3.5 uA | 3.8 uA | 4.5 uA | 4.7 uA |
| 30 V (d = 6.1 nm) | 3.9 uA | 2.7 uA | 2.6 uA | 2.5 uA | 2.7 uA | 2.6 uA | 2.8 uA | 4.3 uA | 4.6 uA | 5.8 uA | 6.8 uA |

From these results, compared with the electron-emitting devices for comparison examples 1 and 2, it is apparent that the emission current Ie is large and the electron emission efficiency η is superior for the electron-emitting devices of the invention when the difference h of the thickness between the first portion B and the second and the third portions 35 and 36 is equal to or greater than 2d.

Furthermore, it is also known through calculations performed by the present inventors that, when the difference h of the thickness between the first portion B and each of the second and the third portions 35 and 36 is equal to or greater than 80 nm, the emission current Ie and the electron emission efficiency η are greater than those obtained for the electron-emitting devices manufactured for comparison examples 1 and 2. Therefore, there is no upper limit to the difference h of the thickness between the first portion B and the second and the third portions 35 and 36. However, for the image display device employing the electron-emitting device of the invention, it is preferable that the thickness difference h be equal to or smaller than 200d because of manufacturing costs and quality control (e.g., prevention of discharge).

After the characteristics are evaluated, the electron-emitting devices of this embodiment were driven for an extended period of time by applying the same pulse voltage as was applied for the characteristic evaluation. As a result, the characteristics shown in Tables 3 and 4 could be maintained for a long time.

After the characteristics are evaluated, the cross-section SEM images of the electron-emitting devices of this embodiment are observed. The thickness of the first portion B of the second carbon film 21*b* is 20 nm, and the distance w of the second and the third portions 35 and 36 of the second carbon film 21*b* is 30 nm. The thickness D ("depth" D) of the second carbon film 21*b* in the direction in which the portion A of the first carbon film 21*a* is opposite the portion B of the second carbon film 21*b* (the direction in which the electrons are emitted) is 20 nm (see FIG. 1 for the "depth" D). The thickness differences h between the first portion B of the second carbon film 21*b* and the second and the third portions 35 and 36 are 3 nm, 5 nm, 7 nm, 9 nm, 11 nm, 13 nm, 30 nm, 50 nm and 80 nm.

Moreover, the substrate-deformed portion (recessed portion) 22 is formed in the surface of the substrate 1 between the first and the second carbon films 21*a* and 21*b*.

Third Embodiment

In a third embodiment, there is a change in the thickness D ("depth" D) of the second carbon film 21*b* that is present in the direction in which the portion A of the first carbon film 21*a* is opposite to the portion B of the second carbon film 21*b* (the direction in which electrons are emitted).

In this embodiment, electron-emitting devices are manufactured in the same manner as in the first embodiment, except that (Step-f) in the first embodiment is changed, and that only (Step-f) will now be described. Comparison Examples 1 and 2 are also the same as those used for the first embodiment.

(Step-f)

The electron-emitting devices manufactured in this embodiment at (Step-a) to (Step-e) are extracted to the air from the measurement/evaluation apparatus in FIG. 6, and as is described above, the process for changing the shape of a carbon film is performed by using the AFM (see FIGS. 11A and 11B). By scraping the end of the carbon film 21*b*, the first portion B, the second portion 35 and the third portion 36 are formed (FIG. 11B).

During the "activation" process, for the individual electron-emitting devices manufactured by changing the maximum value of the voltage to be applied, the thickness of the first portion B is adjusted to 20 nm by using the AFM. Furthermore, the distance w between the second and the third portions 35 and 36 is defined as 30 nm, and the thickness difference h between the first portion B and the second and the third portions 35 and 36 is defined as 80 nm. As a result, seven types of electron-emitting devices are provided wherein the thicknesses D (the "depths" D) for the second carbon film 21*b*, in the direction in which the portion A of the first carbon film 21*a* is opposite the portion B of the second carbon film 21*b*, are 3 nm, 5 nm, 7 nm, 10 nm, 30 nm, 50 nm and 100 nm. Since the end A of the carbon film 21*a* is not scraped and remained unprocessed, the thickness of the end A was 20 nm. This process is performed at multiple places along the gap 8, specifically, at the portions where the gap 8 is narrower than at the other areas, i.e., where the distance between the first and the second carbon films is shorter.

The electron emission characteristics of the electron-emitting devices of the third embodiment are measured in the same manner as in the first embodiment. The electron emission efficiencies obtained through calculation are shown in Table 5, and the emission currents Ie obtained through measurement are shown in Table 6.

[Table 5]

TABLE 5

| | Comparison Example 1 | Comparison Example 2 | Embodiment 3 | | | | | | |
|---|---|---|---|---|---|---|---|---|---|
| | | | 3 nm | 5 nm | 7 nm | 10 nm | 30 nm | 50 nm | 100 nm |
| 12 V (d = 2.2 nm) | 0.08% | 0.05% | 0.19% | 0.22% | 0.21% | 0.21% | 0.20% | 0.20% | 0.18% |
| 22 V (d = 4.3 nm) | 0.18% | 0.10% | 0.45% | 0.48% | 0.48% | 0.46% | 0.43% | 0.45% | 0.43% |
| 30 V (d = 6.2 nm) | 0.49% | 0.30% | 0.77% | 0.79% | 0.78% | 0.80% | 0.78% | 0.76% | 0.76% |

[Table 6]

TABLE 6

| | Comparison Example 1 | Comparison Example 2 | Embodiment 3 3 nm | 5 nm | 7 nm | 10 nm | 30 nm | 50 nm | 100 nm |
|---|---|---|---|---|---|---|---|---|---|
| 12 V (d = 2.2 nm) | 1.1 uA | 0.68 uA | 2.4 uA | 2.8 uA | 2.7 uA | 2.6 uA | 2.4 uA | 2.3 uA | 2.3 uA |
| 22 V (d = 4.3 nm) | 2.1 uA | 1.2 uA | 4.9 uA | 5.1 uA | 5.3 uA | 5.1 uA | 4.8 uA | 4.8 uA | 4.5 uA |
| 30 V (d = 6.2 nm) | 3.9 uA | 2.7 uA | 6.8 uA | 7.1 uA | 7.1 uA | 7.5 uA | 7.3 uA | 7.0 uA | 6.7 uA |

According to these results, compared with the electron-emitting devices for comparison examples 1 and 2, the emission current Ie is large and the electron emission efficiency η is superior for the electron-emitting devices of the invention, regardless of the thickness D of the second carbon film 21*b* (the "depth" D) present in the direction in which the portion A of the first carbon film 21*a* is opposite the portion B of the second carbon film 21*b* (the direction in which electrons are emitted).

It is also known through calculation performed by the present inventors that, when the thickness D of the second carbon film 21*b*, present in the direction in which the portion A of the first carbon film 21*a* is opposite the portion B of the second carbon film 21*b*, is equal to or greater than 10 nm, the emission current Ie and the electron emission efficiency η are greater than those for the electron-emitting devices for comparison examples 1 and 2. Therefore, so long as the second carbon film 21*b* is thick enough to appropriately provide a potential, there is no specific limit on the thickness D of the second carbon film 21*b* in the direction in which the portion A of the first carbon film 21*a* is opposite the portion B of the second carbon film 21*b* (the direction in which electrons are emitted).

However, for an image forming apparatus or an image display device employing the electron-emitting device of this invention, it is preferable that the thickness D of the second carbon film 21*b* be equal to or smaller than 200d because of manufacturing costs and quality control (e.g., prevention of discharge).

After the characteristics are evaluated, the electron-emitting devices of this embodiment are driven for an extended period of time by applying the same pulse voltage as was applied for the characteristic evaluation. As a result, the characteristics shown in Tables 5 and 6 could be maintained for a long time.

After the characteristics are evaluated, the cross-section SEM images of the individual electron-emitting devices of the embodiment are observed. The thickness of the first portion B of the second carbon film 21*b* is 20 nm, the thickness difference h between the first portion of the second carbon film 21*b* and the second and third portions 35 and 36 of the second carbon film 21*b* is 80 nm, and the distance w between the second and the third portions 35 and 36 is 30 nm. Further, it could be confirmed that the thicknesses D for the second carbon film 21*b*, in the direction in which the portion A of the first carbon film 21*a* is opposite the portion B of the second carbon film 21*b* (direction in which electrons are emitted), are 3 nm, 5 nm, 7 nm, 10 nm, 30 nm, 50 nm and 100 nm.

Furthermore, it could be confirmed that the substrate-deformed portion (recessed portion) 22 is formed in the surface of the substrate 1 between the first and the second carbon films 21*a* and 21*b*.

Fourth Embodiment

In a fourth embodiment of this invention, an electron source is constituted by arranging the electron-emitting devices of the invention in a matrix shape, and an image display device is provided by using this electron source. The processing according to this embodiment for manufacturing the image display device will now be described.

(Auxiliary Electrode Generation Step)

A PD-200, 2.8 mm thick glass plate (by Asahi Glass Co., Ltd.) that contains a small amount of alkaline elements is employed as the substrate 71. Then, an $SiO_2$ film of 100 nm is deposited on this substrate 71.

Figure 16:
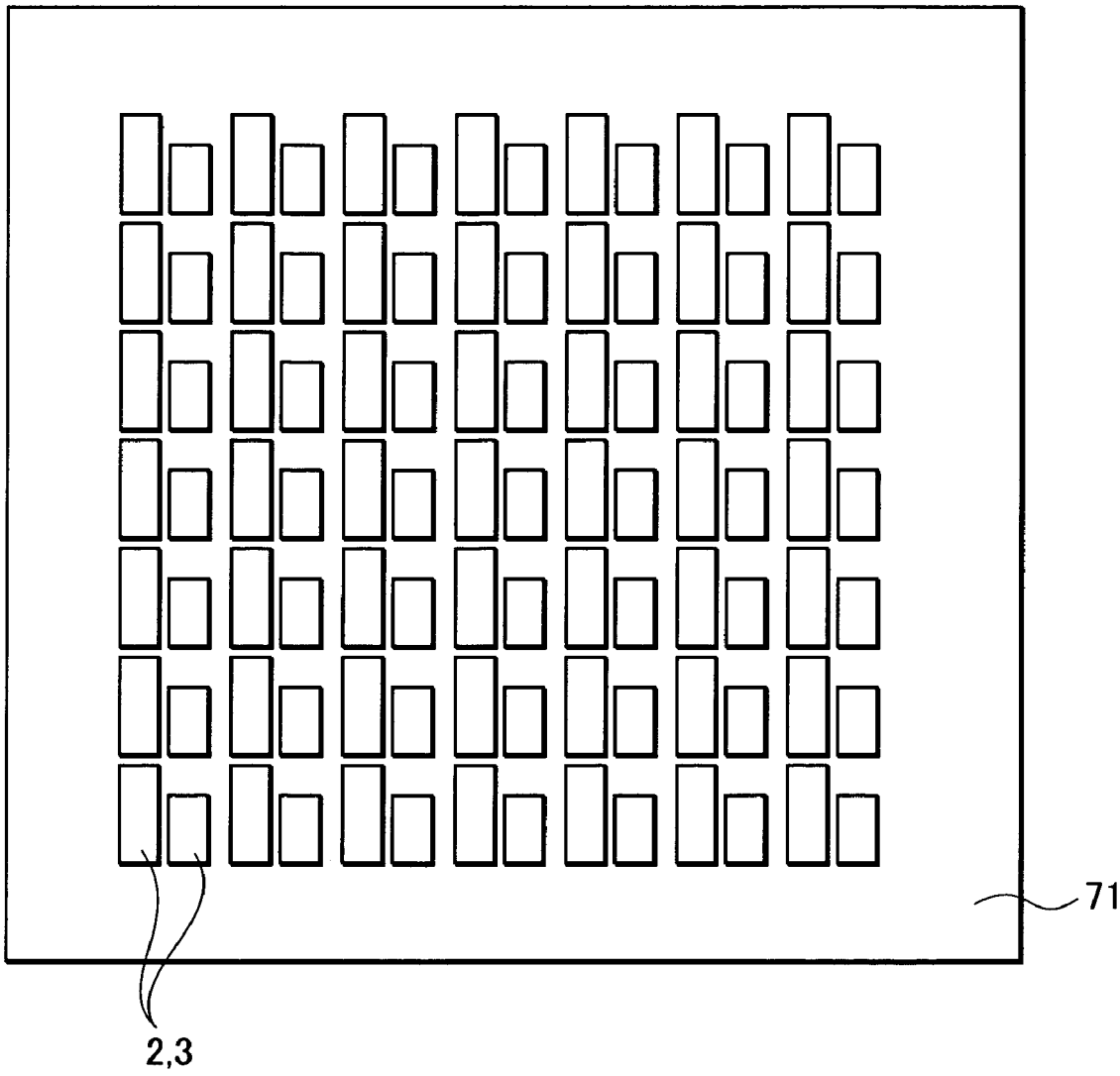
FIG. 16 is a schematic diagram showing an example process for manufacturing an electron source and an image display device according to the invention.

Then, the process for forming multiple first and second auxiliary electrodes 2 and 3 on the substrate 71 is performed (FIG. 16). For this formation, a titanium underlayer of 5 nm and a platinum layer of 40 nm are deposited in order by sputtering, and a photoresist is applied. Thereafter, the resultant structure is patterned by a photolithography series, i.e., exposure, developing and etching. As a result, the first and the second auxiliary electrodes 2 and 3 are formed. In this embodiment, the distance between the first and the second auxiliary electrodes 2 and 3 is 10 μm, and the length of each electrode is 100 μm.

(Y-Directional Wiring Formation Step)

Figure 17:
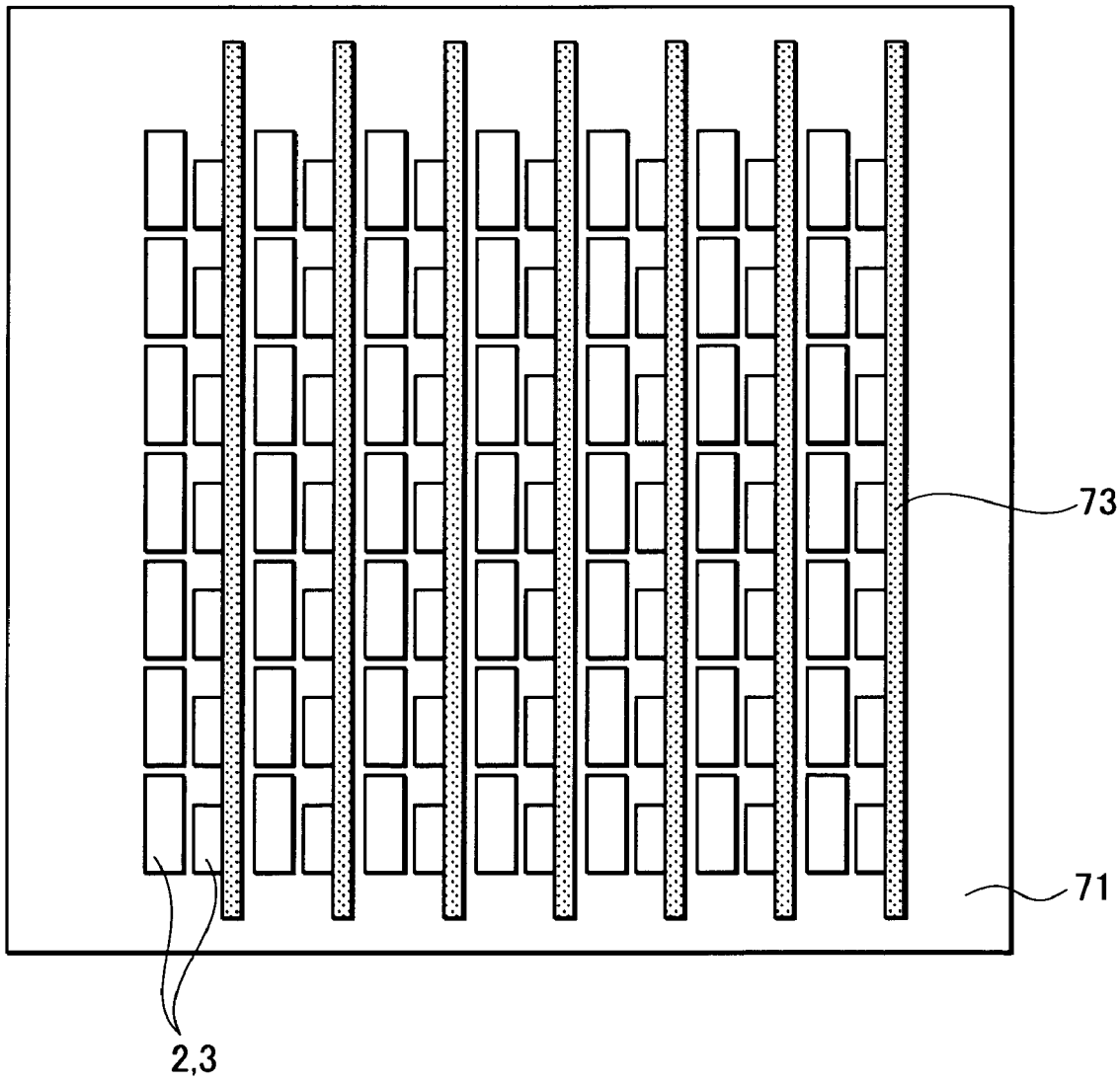
FIG. 17 is a schematic diagram showing an example process for manufacturing an electron source and an image display device according to the invention.

As is shown in FIG. 17, the Y-directional wirings 73 are formed in a line pattern so as to be connected to the auxiliary electrodes 3 and so as to connect these electrodes 3 together. For the Y-directional wirings 73, silver (Ag) photopaste ink is screen printed, dried, exposed and developed to a predetermined pattern. Thereafter, the line pattern is annealed at a temperature of around 480° C. to form wiring. The thickness of the wiring is about 10 μm and the line width is 50 μm. The Y-directional wirings 73 function as wiring for transmitting modulation signals.

(Insulating Layer Formation Step)

Figure 18:
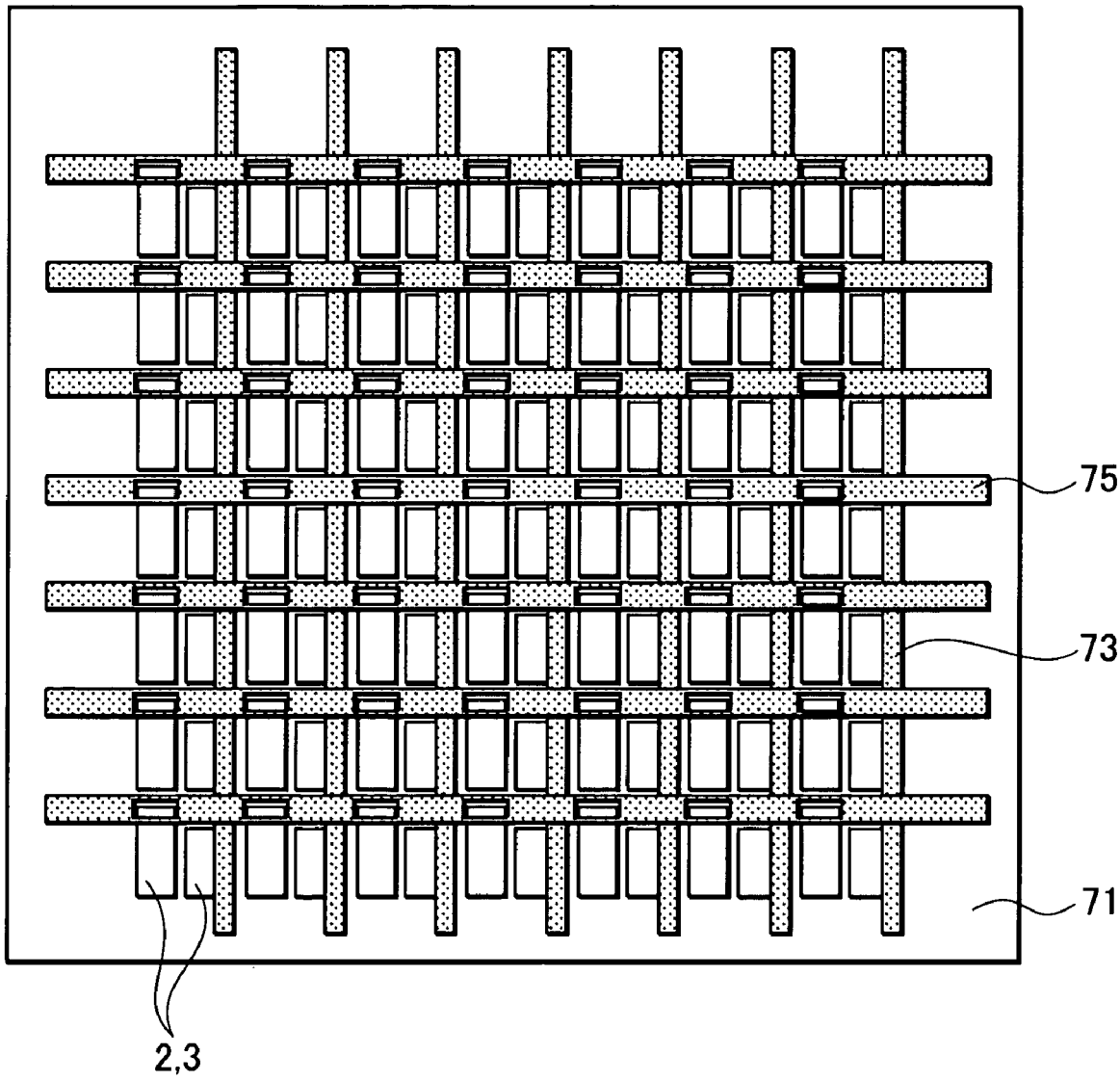
FIG. 18 is a schematic diagram showing an example process for manufacturing an electron source and an image display device according to the invention.

As is shown in FIG. 18, in order to disconnect the X-directional wirings 72 (shown in FIG. 19), which are to be manufactured at the following step, from the Y-directional wirings 73, an insulating layer 75 is deposited to cover the above-described Y-directional wirings 73. Contact holes are formed in one part of the insulating layer 75 to enable electrical connection between the X-directional wirings 72 and the auxiliary electrodes 2.

Specifically, a photosensitive glass paste containing PbO as a main element is screen-printed, the exposure process and the developing process are repeated four times, and finally, the resultant structure is annealed at a temperature of around 480° C. The thickness of the insulating layer 75 is 30 μm and the width thereof is 150 μm.

(X-Directional Wiring Formation Step)

Figure 19:
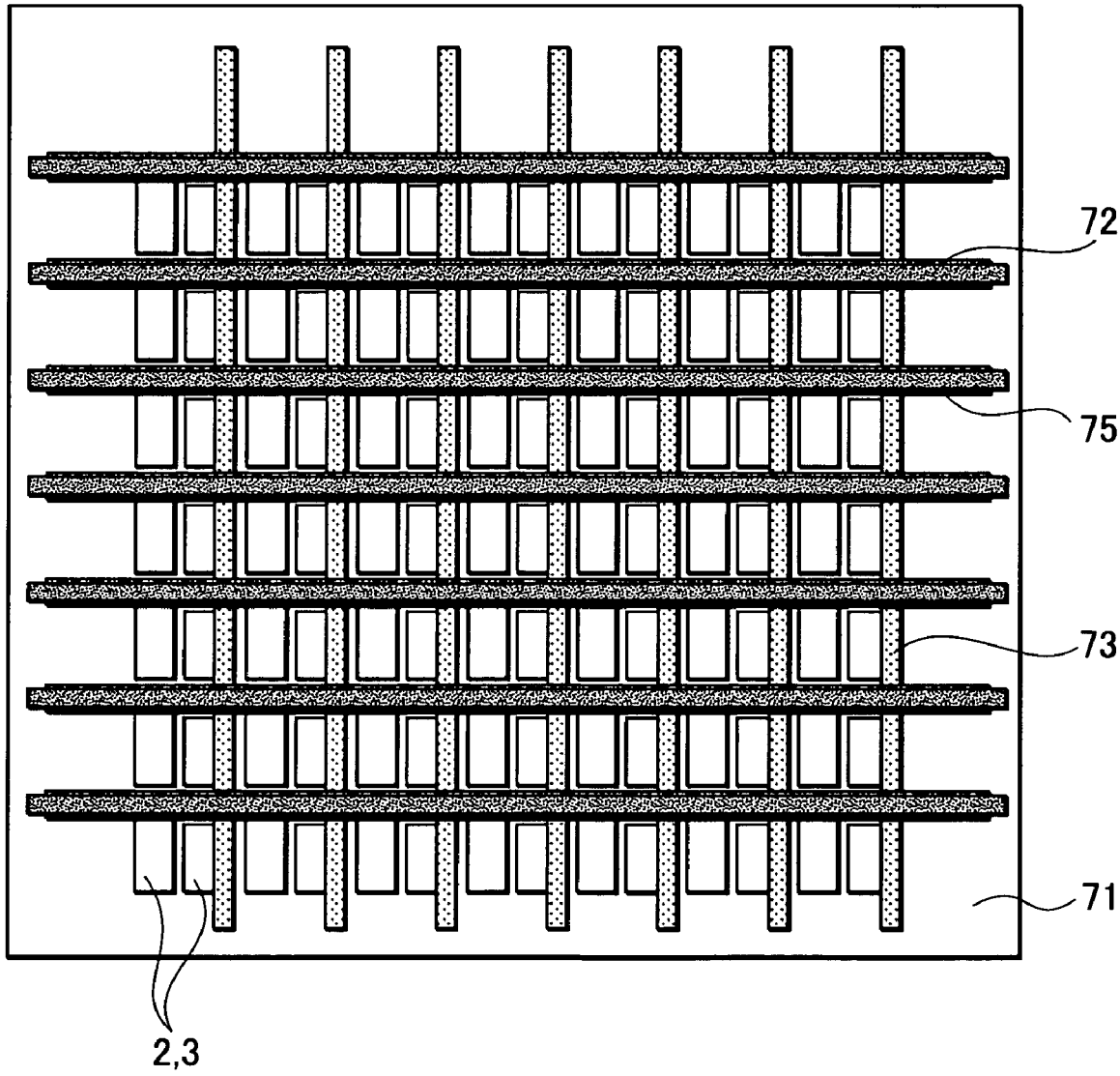
FIG. 19 is a schematic diagram showing an example process for manufacturing an electron source and an image display device according to the invention.

As is shown in FIG. 19, Ag paste ink is screen-printed on the insulating layer 75 previously formed, dried and annealed at a temperature of around 480° C. As a result, the X-directional wirings 72 could be formed. The X-directional wirings 72 intersect the Y-directional wirings 73 with the insulating layer 75 lying between them, and are connected to the auxiliary electrodes 2 through the contact holes formed in the insulating layers 75. The X-directional wirings 72 function as wiring for transmitting scan lines. The thickness of the X-directional wirings 72 is about 15 μm.

The substrate 71 having matrix wiring is thus obtained.

(First Electrode and Second Electrode Formation Step)

Figure 20:
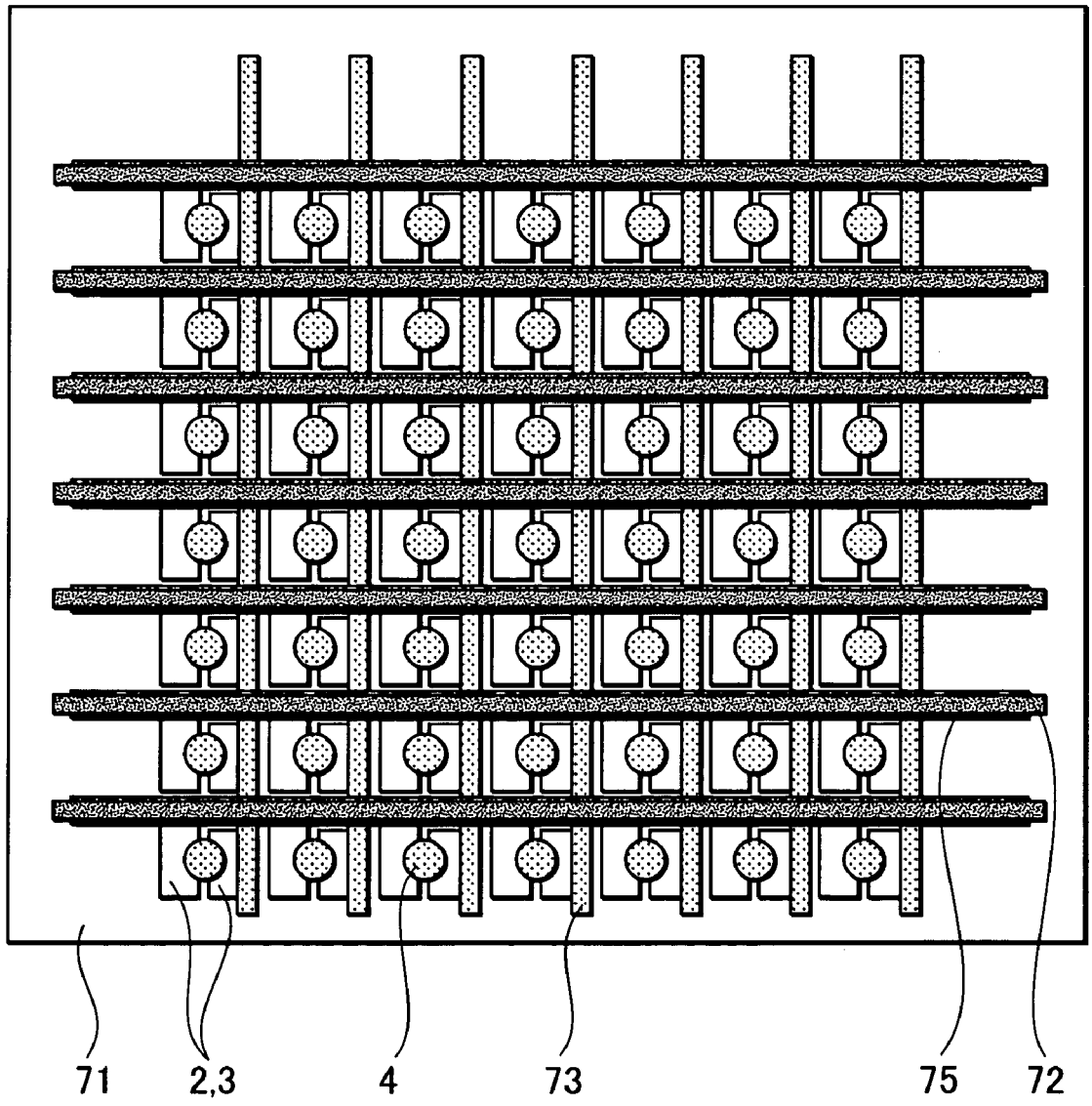
FIG. 20 is a schematic diagram showing an example process for manufacturing an electron source and an image display device according to the invention.

The substrate 71 having the matrix wiring is appropriately cleaned, and the surface is processed by using a solution containing a water repellent to obtain a hydrophobic surface. Through this process, a solution that is applied later for forming a conducive film could appropriately be spread over the auxiliary electrodes 2 and 3. Thereafter, using the ink jet coating method, the conductive film 4 is deposited between the auxiliary electrodes 2 and 3 (FIG. 20).

In this embodiment, ink used for the ink jet coating method is an organic palladium containing a solution wherein a palladium-proline complex of 0.15 weight % is dissolved in an aqueous solution (water: 85%, isopropyl alcohol (IPA): 15%). An ink jet ejection apparatus employing piezoelectric devices is employed to spray the organic palladium containing solution onto the auxiliary electrodes 2 and 3, while the dot diameter is adjusted to 60 μm. Thereafter, the substrate 71 is heated in the air at 350° C. for ten minutes, and the conductive film 4 made of palladium(II) oxide (PdO) is obtained. The diameter of the dot is about 60 μm, and the maximum thickness of the film is 10 nm.

Then, the substrate 71 wherein multiple units, including the auxiliary electrodes 2 and 3 and the conductive film 4 connecting these electrodes, are formed through the above described steps is placed in the vacuum container 23. Thereafter, the pressure in the vacuum container 23 is reduced to be equal to or lower than $1.3\times10^{-3}$ Pa, and the introduction of a reduction gas (a gas mixture of N2=98% and H2=2%) into the vacuum container 23 is started. Then, the "forming" process is initiated.

The "forming" process is performed by applying one pulse selectively to each of the X-directional wirings 72. That is, the process for applying one pulse to one selected X-directional wiring 72, and applying one pulse to another selected X-directional wiring 72 is repeated. The waveform of the pulse voltage to be applied is a triangular pulse, as is shown in FIG. 8B, for which the pulse height is gradually increases for each pulse. The pulse width T1 is defined as 1 msec, and the pulse period T2 is defined as 10 m sec.

After the air is removed from inside the vacuum container 23, the "activation" process is performed. In this embodiment, methanol is employed as a carbon containing gas, and the activation process is performed when the pressure in the vacuum container 23 is $1.3\times10^{-4}$ Pa. The pressure of methanol to be introduced is a little affected by the shape of the vacuum apparatus and the member used for the vacuum apparatus, and $1\times10^{-5}$ Pa to $1\times10^{-2}$ Pa is appropriate. Further, during the "activation" process, the bipolar pulse waveform in FIG. 9B is employed. T1 on the positive polarity side is defined as 1 msec, T1' on the negative polarity side is defined as 0.1 msec, T2 is defined as 10 msec, and the maximum voltage to be applied is defined as ±22 V. During this process, the pulse wave is applied to the auxiliary electrode 2.

After sixty minutes has elapsed since the start of the "activation" process, it is confirmed that the "activation" process has entered the area to the right of the broken line shown in FIG. 10. Then, the application of the pulse voltage is halted, and the introduction of methanol is stopped.

Through the above-described steps, the substrate 71, wherein multiple electron-emitting devices are arranged, could be obtained.

By performing the above-described steps, substrates are prepared on which multiple electron-emitting devices are provided for measurement, and the cross-section TEM images of the individual electron-emitting devices are observed. As schematically shown in FIG. 5A or 5B, the thicknesses were not equal at the ends of the first carbon film 21*a* and the second carbon film 21*b* (the portions that define the outer edge of the gap 8). Furthermore, the thickness of the first carbon 21*a* is 20 nm, while the thickness of the second carbon film 21*b* is 100 nm. The thickness of the second carbon 21*b*, in the direction in which the portion A of the second carbon 21*a* is opposite the portion B of the second carbon 21*b* (the direction in which electrons are emitted), is 100 nm.

The substrate 71 on which provided were multiple electron-emitting devices are provided, for which the "activation" process has been completed, is extracted to the air from the vacuum container, and as described above, the end of the second carbon film 21*b* is changed by using the AFM (see FIGS. 11A and 11B).

By scraping the end of the second carbon film 21*b*using the AFM, the first portion B, the second portion 35 and the third portion 36 are formed (FIG. 11B). In this embodiment, the distance between the second and the third portions 35 and 36 is defined as 30 nm, the thickness of the first portion B is defined as 20 nm, and the thickness difference between the first portion B and the second and the third portions 35 and 36 is defined as 80 nm. Further, the thickness of the second carbon film 21*b*, in the direction in which the portion A of the first carbon film 21*a* is opposite the portion B of the second carbon film 21*b* (the direction in which electrons are emitted), is maintained unchanged, i.e., 100 nm. The end of the carbon film 21*a* is not scraped and is not processed. This process is performed, along the gap 8, for the portions at which the gap 8 is narrower than at the other areas, i.e., where the distance between the first and the second carbon films is shorter. Furthermore, this process is performed for all the electron-emitting devices.

Through the above-described steps, the substrate 71, on which the electron source of the invention (a plurality of the electron-emitting devices) is mounted, is obtained.

Sequentially, as is shown in FIG. 14, the face plate 86 where the fluorescent film 84 and the metal back 85 are laminated on the inner face of the glass substrate 83 is positioned, through the support frame 82, about 2 mm above the substrate 71. In FIG. 14, the rear plate 81 is provided as the reinforcing member for the substrate 71. In other embodiments, however, the rear plate 81 need not be employed, and the joints of the face plate 86, the support frame 82 and the substrate 71 are sealed by heating and cooling In, which is a low-melting metal. Further, since this sealing process is performed in a vacuum chamber, the sealing and closing processes could be performed at the same time, without an exhaust pipe being required.

In this embodiment, in order to provide a color display, the fluorescent film 84, which is an image forming member, is a stripe phosphor (see FIG. 15A). First, the black stripes 91 are formed, and then, the phosphors 92 of the individual colors are applied at the gaps using the slurry method, so as to obtain the fluorescent film 84. The material of the black stripes 91 is a common material that contains graphite as a main element.

The metal back 85 could be obtained by depositing aluminum, by vacuum evaporation, on the inner wall of the fluorescent film 84 (near the electron-emitting device).

For the thus completed image display device, a desired electron-emitting device is selected via the X-directional wiring and the Y-directional wiring, and a pulse voltage of +20 V is applied to the selected electron-emitting device, so that the potential of the second auxiliary electrode of this electron-emitting device is higher than the potential of the first auxiliary electrode. At the same time, a voltage of 8 kV is applied to the metal back 85 via the high voltage terminal Hv. As a result, a bright, satisfactory image could be displayed for an extended period of time.

The mode and embodiments described above are merely examples, and various modifications for the members and the sizes of the members are also included within the steps of the present invention.

While the present invention has been described with reference to exemplary embodiments, it is to be understood that the invention is not limited only to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-147836 filed May 18, 2004 and Patent Application No. 2005-110981 filed Apr. 7, 2005, which are hereby incorporated by reference herein, its entirety.

What is claimed is:

1. An electron-emitting apparatus comprising:

an electron-emitting device including a first conductive film and a second conductive film, arranged at an interval, on a surface of a substrate; and an anode electrode located at a distance H [m] from the surface of the substrate, wherein a voltage Va [V] is applied between the anode electrode and the first conductive film so that a potential of the anode electrode is higher than a potential of the first conductive film, and a drive voltage Vf [V] is applied between the first conductive film and the second conductive film so that a potential of the second conductive film is higher than the potential of the first conductive film, to emit electrons from the first conductive film, wherein a thickness of a first portion of the second conductive film, which is located at a shortest distance d from a portion of the first conductive film in from which electrons are emitted as a result of the drive voltage Vf [V], is equal to or smaller than a thickness of the portion of the first conductive film from which the electrons are emitted, wherein the shortest distance d is smaller than $(Vf \times H)/(\pi \times Va)$, wherein the second conductive film further has a second portion and a third portion, between which the first portion is arranged, wherein the second portion and the third portion of the second conductive film are thicker than the first portion, and wherein a thickness of an end portion of the first conductive film facing the first portion is smaller than each thicknesses of the second portion and the third portion.

* * * * *